US005106716A

United States Patent [19]

Kato et al.

[11] Patent Number: 5,106,716

[45] Date of Patent: Apr. 21, 1992

[54] LIQUID DEVELOPER FOR ELECTROSTATIC PHOTOGRAPHY

[75] Inventors: Eiichi Kato; Hideyuki Hattori, both of Shizuoka, Japan

[73] Assignee: Fuji Photo Film Co., Ltd., Kanagawa, Japan

[21] Appl. No.: 537,723

[22] Filed: Jun. 14, 1990

[30] Foreign Application Priority Data

Jun. 14, 1989 [JP] Japan ..... 1-149305
Sep. 29, 1989 [JP] Japan ..... 1-252442
Sep. 29, 1989 [JP] Japan ..... 1-252443

[51] Int. Cl.[5] ..... G03G 9/13

[52] U.S. Cl. ..... 430/114; 430/115; 430/904

[58] Field of Search ..... 430/112, 114, 115, 904; 524/853

[56] References Cited

U.S. PATENT DOCUMENTS 4,123,374 10/1978 Gilliams et al. ..... 252/62.1 L
4,618,557 10/1986 Dan et al. ..... 430/114
4,665,002 5/1987 Dan et al. ..... 430/114
4,837,102 6/1989 Dan et al. ..... 430/114
4,973,539 11/1990 Sacripante et al. ..... 430/109
5,006,441 4/1991 Kato ..... 430/114

*Primary Examiner*—Marion E. McCamish
*Assistant Examiner*—Rosemary Ashton
*Attorney, Agent, or Firm*—Sughrue, Mion, Zinn, Macpeak & Seas

[57] ABSTRACT

A liquid developer for electrostatic photography is disclosed. The liquid developer of this invention comprises resin grains dispersed in a non-aqueous solvent having an electric resistance of at least $10^9$ Ωcm and a dielectric constant of not higher than 3.5, wherein the dispersed resin grains are copolymer resin grains obtained by polymerizing a solution containing at least one mono-functional monomer (A) which is soluble in the above non-aqueous solvent but becomes insoluble in the non-aqueous solvent by being polymerized, in the presence a dispersion-stabilizing resin, which is soluble in the non-aqueous solvent and is composed of at least one recurring unit represented by the formulae (Ia) and (Ib) having a weight average molecular weight of from $1\times10^3$ to $2\times10^4$ as defined in the specification.

The liquid developer according to the present invention is excellent in redispersibility, storability, stability, image-reproducibility and fixability.

10 Claims, No Drawings

LIQUID DEVELOPER FOR ELECTROSTATIC PHOTOGRAPHY

FIELD OF THE INVENTION

This invention relates to a liquid developer for electrostatic photography, which comprises resin grains dispersed in a liquid carrier having an electric resistance of at least $10^9$ Ω cm and a dielectric constant of not higher than 3.5, and more particularly to an electrophotographic liquid developer excellent in redispersibility, storability, stability, image-reproducibility, and fixability.

BACKGROUND OF THE INVENTION

In general, a liquid developer for electrostatic photography (electrophotography) is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, etc., and further adding a polarity-controlling agent such as a metal soap, lecithin, linseed oil, a higher fatty acid, a vinyl pyrrolidone-containing polymer, etc., to the resulting dispersion.

In such a developer, the resin is dispersed in the form of insoluble latex grains having a grain size of from several nm to several hundred nm. In a conventional liquid developer, however, a soluble dispersion-stabilizing resin added to the liquid developer and the polarity-controlling agent are insufficiently bonded to the insoluble latex grains, thereby the soluble dispersion-stabilizing resin and the polarity-controlling agent are in a state of easily dispersed in the liquid carrier. Accordingly, there is a fault that when the liquid developer is stored for a long period of time or repeatedly used, the dispersion-stabilizing resin is split off from the insoluble latex grains, thereby the latex grains are precipitated, aggregated, and accumulated to make the polarity thereof indistinct. Also, since the latex grains once aggregated or accumulated are reluctant to re-disperse, the latex grains remain everywhere in the developing machine attached thereto, which results in causing stains of images formed and malfunctions of the developing machine, such as clogging of a liquid feed pump, etc.

For overcoming such defects, a means of chemically bonding the soluble dispersion-stabilizing resin and the insoluble latex grains is disclosed in U.S. Pat. No. 3,990,980. However, the liquid developer disclosed therein is still insufficient although the dispersion stability of the grains to the spontaneous precipitation may be improved to some extent. When the above liquid developer is actually used in a developing apparatus, there are same defects that the toner attached to parts of the developing apparatus is solidified in the form of coating and the toner grains thus solidified are reluctant to redisperse and are insufficient in re-dispersion stability for practical use, which causes the malfunction of the apparatus and staining of duplicated images.

In the method for producing resin grains described in aforesaid U.S. Pat. No. 3,990,980, there is a very severe restriction in the combination of a dispersion stabilizer being used and monomer(s) being insolubilized for producing monodispersed latex grains having a narrow grain size distribution. Mostly, the resin grains produced by the aforesaid method are grains of a broad grain size distribution containing a large amount of coarse grains or poly-dispersed grains having two or more different mean grain sizes. In the aforesaid method, it is difficult to obtain monodispersed resin grains having a narrow grain size distribution and having a desired grain size, and the method often results in forming large grains having a mean grain size of 1 [m or larger or very fine grains having a mean grain size of 0.1 μm or less. Furthermore, there is also a problem that the dispersion stabilizer being used must be prepared by an extremely complicated process requiring a long reaction time.

Furthermore, for overcoming the above problems, a method for improving the dispersibility, redispersibility and storage stability of insoluble dispersion resin grains by forming the resin grains with a copolymer of a monomer imparting insolubility and a monomer having a long chain alkyl moiety or a monomer having two or more kinds of polar components is disclosed in JP-A-60-179751 and JP-A-62-151868 (the term "JP-A" as used herein means an "unexamined published Japanese patent application").

Also, a method for improving the dispersibility, redispersibility, and storage stability of insoluble dispersion resin grains by polymerizing a monomer imparting insolubility in the presence of a polymer utilizing di-functional monomer or a polymer formed by utilizing a macromolecular reaction to produce the insoluble dispersion resin grains is disclosed in JP-A-60-185962 and JP-A-61-43757.

On the other hand, a method of printing a large number of prints (e.g., 5,000 or more prints) has recently been developed, using an offset printing master plate by electrophotography. In particular, with the improvement of master plates, it has become possible to print 10,000 or more prints of large size in electrophotographic system. In addition, a noticeable progress has been made in shortening the operation time in an electrophotomechanical system and a system of quickening the development-fixing step has been improved.

The dispersion resin grains prepared by the methods disclosed by aforesaid JP-A-60-179751 and JP-A-62-151868 might be good in the mono-dispersibility, redispersibility, and storage stability of the resin grains, but showed unsatisfactory performance with respect to the printing durability for master plates of large size and quickening of the fixing time.

Also, the dispersion resin grains prepared by the methods disclosed in aforesaid JP-A-60 185962 and JP-A-61-43757 were not always satisfactory in the points of the dispersibility and redispersibility of the resin grains when the development speed was increased and also in the point of the printing durability when the fixing time was shortened or a master plate of a large size (e.g., larger than 297×420 $mm^2$) was employed.

SUMMARY OF THE INVENTION

An object of this invention is to provide a liquid developer excellent in dispersion stability, redispersibility, and fixing property in electrophotomechanical system wherein the development-fixing step is quickened and master plates of a large size are used.

Another object of this invention is to provide a liquid developer capable of forming an offset printing master plate having excellent ink-respectivity for printing ink an excellent printing durability by an electrophotography.

A further object of this invention is to provide a liquid developer suitable for various electrostatic photographies and various transfer systems in addition to the aforesaid uses.

A still further object of this invention is to provide a liquid developer capable of being used for any liquid developer-using systems such as ink jet recording, cathode ray tube recording, and recording by pressure variation or electrostatic variation.

The above and other objects of the present invention have been attained by the present invention as set forth hereinbelow.

That is, according to this invention, there is provided a liquid developer for electrostatic photography comprising resin grains dispersed in a non-aqueous solvent having an electric resistance of at least $10^9$ Ω cm and a dielectric constant of not higher than 3.5, wherein the dispersed resin grains are copolymer resin grains obtained by polymerizing a solution containing at least one mono-functional monomer (A) which is soluble in the non-aqueous solvent but becomes insoluble in the non-aqueous solvent by being polymerized, in the presence of a dispersion-stabilizing resin which in soluble in the non-aqueous solvent and is composed of at least one recurring unit represented by the following formulae (Ia) and (Ib) having a weight average molecular weight of from $1\times10^3$ to $2\times10^4$:

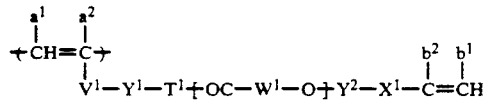

(Ia)

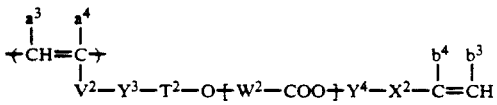

(Ib)

In formula (Ia), $V^1$ represents a single bond or $$-COO-,\ -OCO-,\ -O-,\ \text{-}(CH_2)_n\text{-}COO-,$$

$$\text{-}(CH_2)_n\text{-}OCO-,\ -CO-,\ -SO_2-,\ -\overset{R^1}{\overset{|}{C}}ON-,$$

$$-SO_2\overset{R^1}{\overset{|}{N}}-,\ -CONHCOO-,\ -CONHCONH-,\ \text{or}$$

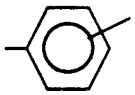

(wherein $R^1$ represents a hydrogen atom or a hydrocarbon group having from 1 to 22 carbon atoms and n represents an integer of from 1 to 3); $X^1$ has the same meaning as $V^1$ described above; $Y^1$ represents a group linking $V^1$ to $T^1$; $Y^2$ represents a group linking $X^1$ to the recurring unit; $T^1$ represents —O— or —NH—; $W^1$ represents a divalent aliphatic organic residue or a linkage group represented by $-Q^1-COO-Q^2-$ (wherein $-Q^1-$, and $-Q^2-$, which may be the same or different, each represents a divalent organic residue which may be bonded via a hetero atom): $a^1$ and $a^2$, which may be the same or different, each represents a hydrogen atom, a halogen atom, a cyano group, a hydrocarbon group having from 1 to 8 carbon atoms, $-COO-R^2$, or $-COO-R^2$ bonded via a hydrocarbon group (wherein $R^2$ represents a hydrogen atom or a hydrocarbon group having from 1 to 18 carbon atoms); and $b^1$ and $b^2$, which may be the same or different, have the same meaning as a: and az described above; and in formula (Ib), $V^2$ and $X^2$ have the same meaning as $V^1$ and $X^1$ in formula (Ia); $Y^3$ represents a group linking $V^2$ to $T^2$; $Y^4$ represents a group linking $X^2$ to the recurring unit; $W^2$ represents a divalent aliphatic organic residue or a linkage group represented by $-Q_3-OCO-Q^4-$ (wherein $-Q^3-$ and $-Q^4-$, which may be the same or different, have the same meaning as $-Q^1-$ and $-Q^2-$ in formula (Ia); $T^2$ represents —CO— or a single bond; and $a^3$, $a^4$, $b^3$, and $b^4$, which may be the same or different, have the same meaning as $a^1$ and $a^2$ in formula (Ia).

In the present invention, it is preferred that the aforesaid dispersion-stabilizing resin contains a recurring unit having a long chain aliphatic group represented by formula (III);

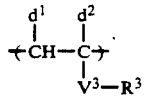

wherein $V^3$ represents —COO—, —OCO—, —O—, $-CH_2)_mOCO-$, —CO—, or $-SO_2-$ (wherein m represents an integer of from 1 to 3); $R^3$ represents an alkyl or alkenyl group having at least 8 carbon atoms; and $d^1$ and $d^2$, which may be the same or different, have the same meaning as $a^1$ and $a^2$ in formula (Ia).

DETAILED DESCRIPTION OF THE INVENTION

Then, the liquid developer of this invention is described hereinafter in detail.

As the liquid carrier for the liquid developer of this invention having an electric constant of at least $10^9$ Ω cm and a dielectric constant of not higher than 3.5, straight chain or branched aliphatic hydrocarbons, alicyclic hydrocarbons, aromatic hydrocarbons, and the halogen-substitution products of them can be preferably used. Specific examples thereof are octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name by Shell Oil Co.), Amsco OMS and Amsco 460 solvents (Amsco: trade name by American Mineral Spirits Co.), etc., and they may be used singly or as a mixture thereof.

The dispersion resin grains in non-aqueous system (hereinafter, is often referred to as "dispersion resin grains" or "latex grains") which is the most important constituting element in this invention, are produced by polymerizing (by so-called polymerization granulation method) the monomer (A) in the presence of the aforesaid dispersion-stabilizing resin in a non-aqueous solvent.

As the non-aqueous solvent in the aforesaid polymerization, any solvents which are miscible with the aforesaid liquid carrier for the liquid developer of this invention can be basically used.

That is, as the non-aqueous solvent which is used for the production of the dispersion resin grains, there are preferably straight chain or branched aliphatic hydrocarbons, alicyclic hydrocarbons, aromatic hydrocarbons, and the halogen-substitution products thereof. Examples thereof are hexane, octane, isooctane, decane, isodecane, decalin, nonane, dodecane, isododecane, Isopar E, Isopar G, Isopar H, Isopar L, Shellsol 70, Shellsol 71, Amsco OMS, and Amsco 460, and they may be used alone or as a mixture thereof.

Other organic solvent(s) can be used, if desired, together with the aforesaid non-aqueous solvent for the production of the dispersion resin grains, and examples thereof include alcohols (e.g., methanol, ethanol, propyl alcohol, butyl alcohol, and fluorinated alcohols), ketones (e.g., acetone, methyl ethyl ketone, and cyclohexane), carboxylic acid esters (e.g., methyl acetate, ethyl acetate, propyl acetate, butyl acetate, methyl propionate and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methyl chloroform).

It is preferred that the aforesaid solvent being used with the aforesaid non-aqueous solvent is distilled off by heating or under normal pressure or under reduced pressure after the polymerization granulation is completed. However, even when such a solvent is brought in the liquid developer as a latex grain dispersion, the existence of the solvent given no problems as long as the electric resistance of the liquid developer satisfies the condition that the electric resistance of the solvent is at least $10^9$ Ω cm.

In general, it is preferred that the same solvent as the liquid carrier for the liquid developer is used in the step of producing the resin grain dispersion and, such solvents include the straight chain or branched aliphatic hydrocarbons, alicyclic hydrocarbons, aromatic hydrocarbons, or halogenated hydrocarbons, etc., as described above.

The dispersion-stabilizing resin for use in this invention is a comb-like copolymer composed of the recurring unit shown by formula (Ia) and/or the recurring unit shown by formula (Ib), and the resin is soluble in the aforesaid non-aqueous solvent (carrier liquid) and has, as a feature thereof, a polymerizable double bond group bonded to the terminal of the comb portion.

It is preferred that the aforesaid comb-like copolymer further contains the recurring unit component shown by the aforesaid formula (III). That is, the comb-like copolymer is preferably composed of the recurring unit shown by formula (Ia) and/or the recurring unit shown by formula (Ib) and the recurring unit shown by formula (III).

The weight average molecular weight of the comb-like copolymer is from $1\times10^4$ to $2\times10^5$, and preferably from $2\times10^4$ to $1\times10^5$. If the weight average molecular weight is less than $1\times10^4$ or more than $5\times10^5$, the mean grain size of the resin grains obtained by the polymerization granulation becomes coarse or the grain size distribution thereof becomes broad, whereby the monodispersibility thereof is lost and further the resin grains aggregate without forming a dispersion.

The content of the component shown by formula (Ia) and/or the component shown by formula (Ib) as a copolymer component for the comb-like copolymer is from 1% by weight to 70% by weight, and preferably from 5% by weight to 50% by weight. If the content thereof is less than 1% by weight, the number of the comb portions is greatly reduced to form a chemical structure similar to a conventional random copolymer, whereby the improvement of the redispersibility, which is an effect of this invention, is not obtained. On the other hand, if the content exceeds 70% by weight, the copolymerizing property of the component with a monomer corresponding to the recurring unit shown by the aforesaid formula (III) becomes insufficient, and also the content of the polymerizable double bond graft bonding to the monomer (A) in the dispersion-stabilizing resin is too increased, which results in aggregation or gelation of the resin grains in the case of forming the resin grains by polymerization granulation.

Also, the content of the copolymer component shown by formula (III), which is used as a preferred copolymer component for the dispersion-stabilizing resin, is from 30 to 99 by weight, and preferably from 50 to 95% by weight.

The weight average molecular weight of the component shown by formula (Ia) and/or the component shown by formula (Ib) which forms the comb portions of the comb-like copolymer is from $1\times10^3$ to $2\times10^4$, and preferably from $2\times10^3$ to $1\times10^4$. If the weight average redispersibility of the dispersion resin grains obtained is reduced. Also, if the weight average molecular weight exceeds $2\times10^4$, the efficiency of the graft bonding with the monomer (A) is reduced thereby resulting in poor redispersibility of the resin grains.

Then, the comb-like copolymer which is the dispersion-stabilizing resin is described in detail.

In formulae (Ia) and (Ib), the hydrocarbon group shown by al, $a^2$, $a^3$, $a^4$, $b^1$, $b^2$, $b^3$, $b^4$, $V^1$, $V^2$, $X^1$ and $X^2$ has the number of carbon atoms (as unsubstituted hydrocarbon group) indicated in each case and may be substituted.

In formula (Ia), $R^1$ in the substituent shown by $V^1$ represents a hydrogen atom or a hydrocarbon group, and preferred examples of the hydrocarbon group are an alkyl group having from 1 to 22 carbon atoms, which may be substituted (e.g., methyl, ethyl, propyl, butyl, heptyl, hexyl, octyl, decyl, dodecyl, tridecyl, tetradecyl, hexadecyl, octadecyl, 2-chloroethyl, 2-bromoethyl, 2-cyanoethyl, 2-methoxycarbonylethyl, 2-methoxyethyl, an 3-bromopropyl), and alkenyl group having from 4 to 18 carbon atoms, which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms, which may be substituted (e.g., benzyl, phenethyl, 3-phenylpropyl, naphthylmethyl, 2-naphthyl ethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms, which may be substituted (e.g., cyclohexyl, 2-cyclohexylethyl, and 2-cyclopentylethyl), and an aromatic group having from 6 to 12 carbon atoms (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, ethoxycarbonylphenyl, butoxycarbonylphenyl, acetamidophenyl, propioamidophenyl, and dodecyloylamidophenyl).

When $V^1$ represents

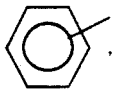

the benzene ring may have a substituent such as a halogen atom (e.g., chlorine and bromine), an alkyl group (e.g., methyl, ethyl, propyl, butyl, chloromethyl, and methoxymethyl), etc.

In formula (Ia), $a^1$ and $a^2$, which may be the same or different, each represents preferably a hydrogen atom, a halogen atom (e.g., chlorine, bromine, and fluorine), a cyano group, an alkyl group having from 1 to 3 carbon atoms (e.g., methyl, ethyl, and propyl), —COO—$R^2$ or —$CH_2COOR^2$ (wherein $R^2$ represents preferably a hydrogen atom, an alkyl group having from 1 to 18 carbon atoms, an alkenyl group, an aralkyl group, an alicyclic group, or an aryl group, these group may be substituted, and specific examples of these groups are the same as those described above for $R^1$).

$Y^1$ represents group linking $V^1$ to $T^1$ and is a single bond or a linkage group. Specific examples of the linkage group include a linkage group selected from

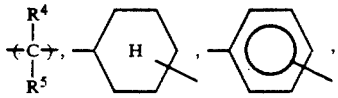

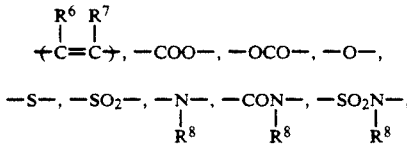

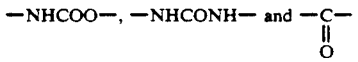

and a bonding group formed by a combination of these linkage groups (wherein $R^4$, $R^5$, $R^6$, and $R^7$, which may be the same or different, each represents a hydrogen atom, a halogen atom (e.g., preferably fluorine, chlorine, and bromine), or a hydrocarbon group having from 1 to 7 carbon atoms (e.g., preferably, methyl, ethyl, propyl, butyl, 2-chloroethyl, 2-methoxyethyl, 2-methoxycarbonylethyl, benzyl, methoxybenzyl, phenyl, methoxyphenyl, and methoxycarbonylphenyl) and $R^8$ has the same meaning as $R^1$ described above).

$W^1$ represents a divalent aliphatic organic residue or the linkage group shown by $Q^1$—COO—$Q^2$—.

When $W^1$ represents a divalent aliphatic organic residue, specific examples of the organic residue are —$CH_2)_p$ (wherein p represents an integer of from 2 to 18),

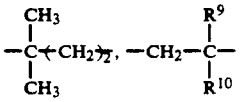

wherein $R^9$ and $R^{10}$, which may be the same or different, each represents a hydrogen atom or an alkyl group having from 1 to 12 carbon atoms (e.g., methyl, ethyl, propyl, butyl, hexyl, octyl, and decyl), with the proviso that $R^9$ and $R^{10}$ do not simultaneously represent hydrogen atoms),

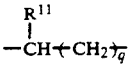

(wherein $R^{11}$ represents an alkyl group having 1 to 12 carbon and specific examples thereof are the same as the alkyl groups shown by $R^9$ and $R^{10}$ described above; and q represents an integer of from 3 to 18).

When $W^1$ represents a linkage group of —$Q^1$—COO—$Q^2$—, —Q— and —$Q^2$—, which may be the same or different, each represents a divalent organic residue, such as a divalent aliphatic group, a divalent aromatic group, a divalent heterocyclic group, or an organic residue composed of a combination of these divalent residues (groups) each may contain a bonding group selected from

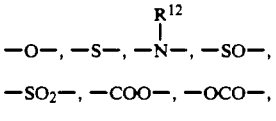

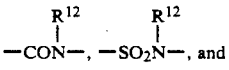

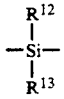

wherein $R^{14}$ and $R^{15}$, which have the same meaning as $R^1$ described above.

Specific examples of the aforesaid divalent aliphatic group are

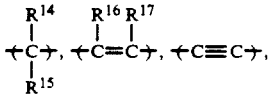

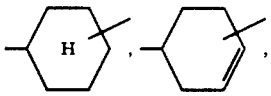

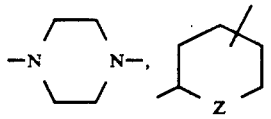

(wherein $R^{14}$ and $R^{15}$, which may be the same or different, each represents a hydrogen atom, a halogen atom (e.g., fluorine, chlorine, and bromine), or an alkyl group having from 1 to 12 carbon atoms, which may be substituted (e.g., methyl, ethyl, propyl, chloromethyl, bromomethyl, butyl, hexyl, octyl, nonyl, and decyl); $R^{16}$ and $R^{17}$, which may be the same or different, have the same meaning as $R^{14}$ and $R^{15}$ described above; and Z represents —S—, —O—, or —$NR^{18}$— (wherein $R^{18}$ represents an alkyl group having from 1 to 4 carbon atoms, —$CH_2Cl$, or —$CH_2Br$)).

Specific examples of the aforesaid divalent aromatic group include a benzene ring group and a naphthalene ring group. Also, specific examples of the aforesaid divalent heterocyclic group are 5- and 6-membered heterocyclic groups (containing at least one kind of hetero atom selected from oxygen, sulfur, and nitrogen as the hetero atom constituting the heterocyclic ring).

These aromatic and heterocyclic groups may have a substituent such as a halogen atom (e.g., fluorine, chlorine, and bromine), an alkyl group having from 1 to 8 carbon atoms (e.g., methyl, ethyl, propyl, butyl, hexyl, and octyl), or an alkoxy group having from 1 to 6 carbon atoms (e.g., methoxy, ethoxy, propoxy and butoxy).

Specific examples of the aforesaid heterocyclic group are furan, thiophene, pyridine, piperizine, tetrahydrofuran, pyrrole, tetrahydropyrane, and 1,3-oxazoline.

In formula (Ia), $X^1$ has the same meaning as $V^1$, and $Y^2$ has the same meaning as $Y^1$.

Also, $a^1$ and $a^2$, which may be the same or different, each represents a hydrogen atom, a halogen atom (e.g., chlorine, bromine, and fluorine), a cyano group, an alkyl group having from 1 to 3 carbon atoms (e.g., methyl, ethyl, and propyl), —$COOR^2$, or —$CH_2COOR^2$ (wherein $R^2$ preferably represents an alkyl group having from 1 to 8 carbon atoms (e.g., methyl, ethyl, propyl, butyl, pentyl, hexyl, and octyl), an aralkyl group having from 7 to 9 carbon atoms (e.g., benzyl, phenethyl, and 3-phenylpropyl), or a phenyl group which may be substituted (e.g., phenyl, tolyl, xylyl, and methoxyphenyl)).

Furthermore, $b^1$ and $b^2$, which may be the same or different, have the same meaning as $a^1$ and $a^2$.

In a more preferred embodiment of formula (Ia), one of $a^1$ and $a^2$ represents a hydrogen atom or at least one of $b^1$ and $b^2$ represents a hydrogen atom.

In formula (Ib), $a^3$, $a^4$, $b^3$, and $b^4$ have the same meaning as $a^1$ and $a^2$ in formula (Ib).

Also, $V^2$ and $X^2$ have the same meaning as $V^1$ and $Y^1$ in formula (Ia); $Y^3$ represents a group linking $V^2$ to $T^2$; and $Y^3$ represents a group linking $X^2$ to the recurring unit.

$Z^2$ represents a single bond or —CO—.

$W^2$ represents a divalent aliphatic organic residue or a linkage group shown by —$Q^3$—OCO—$Q^4$—. Specific examples of the divalent aliphatic organic residue and —$Q^3$— and —$Q^4$— are the same as those of the divalent aliphatic organic residue and —$Q^1$— and —$Q^2$— described above for $W^1$.

In formulae (Ia) and (Ib), specific examples of the moieties shown by

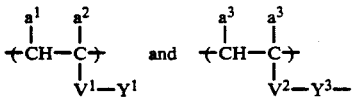

are illustrated below, but the scope of this invention is not limited thereto.

In the following formulae, a represents —H, —$CH_3$, —$CH_2COOCH_3$—, —Cl, —Br, or —CN; b represents —H or —$CH_3$; h represents an integer of from 2 to 12; and i represents an integer of from 1 to 12.

(A-1)

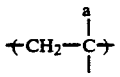

-continued (A-2)

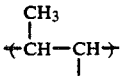

(A-3)

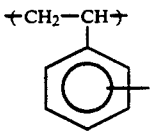

(A-4)

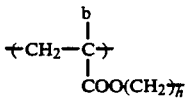

(A-5)

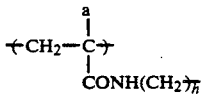

(A-6)

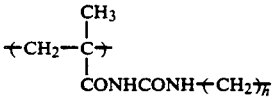

(A-7)

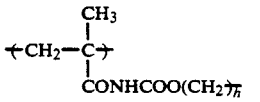

(A-8)

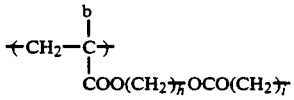

(A-9)

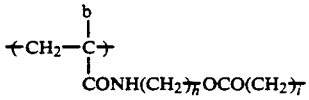

(A-10)

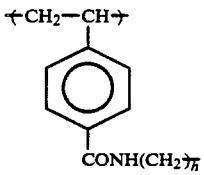

(A-11)

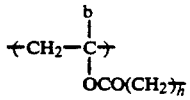

(A-12)

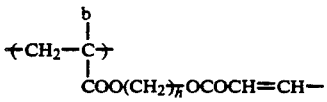

(A-13)

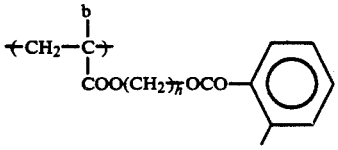

(A-14)

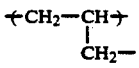

-continued
(A-15)
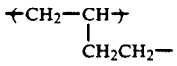
(A-16)
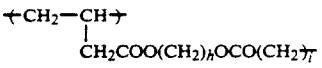
(A-17)
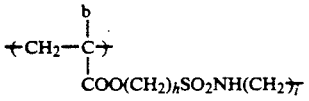
(A-18)
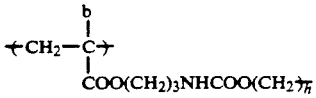
(A-19)
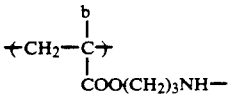
(A-20)
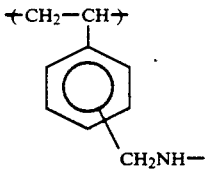
(A-21)
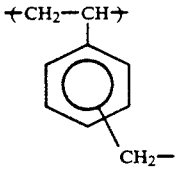
(A-22)
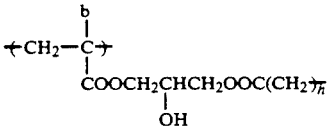
(A-23)
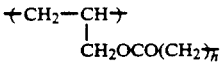
(A-24)
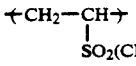
(A-25)
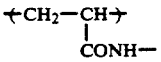
(A-26)
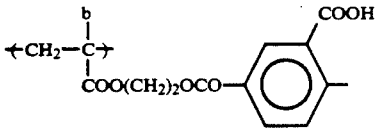
(A-27)
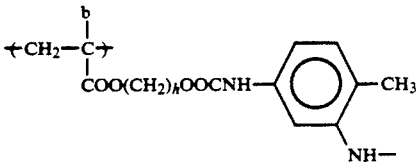
-continued
(A-28)
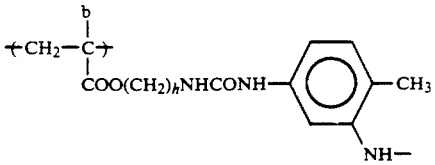
(A-29)
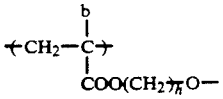
(A-30)
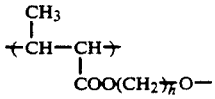
(A-31)
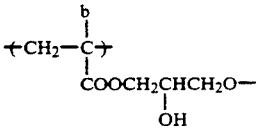
(A-32)
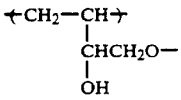
(A-33)
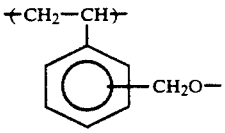
(A-34)
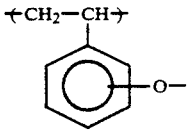
(A-35)
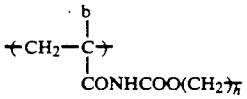
(A-36)
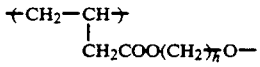
On the other hand, in formulae (Ia) and (Ib), specific examples of the moieties shown by
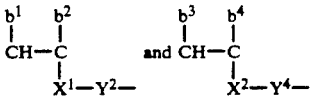
each showing the polymerizable double bond group bonded to the terminal of the comb portion are the same as those of the double bond group corresponding to
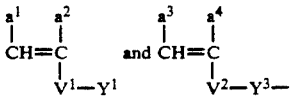
in aforesaid -continued

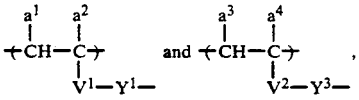

bu the present invention is not limited thereto.

Then, specific examples of the $Q^1$, $Q^2$, $Q^3$, and $Q^4$ are illustrated below, but the present invention is not limited thereto.

In the following formulae, $R^a$ represents an alkyl group having from 1 to 4 carbon atoms, $—CH_2Cl$, or $—CH_2Br$; $R^6$ represents and alkyl group having from 1 to 8 carbon atoms, $—CH_2)_lOR^a$ (wherein $R^a$ is the same as above and l represents an integer of from 2 to 8), $—CH_2Cl$, or $—CH_2Br$; $R^c$ represents —H or $—CH_3$; $R^d$ represents an alkyl group having from 1 to 4 carbon atoms; Z represents —O—, —S—, or $NR^a$ (wherein $R^a$ is the same as described above); p represents an integer of from 1 to 26; q represents an integer of from 0 to 4; r represents an integer of from 1 to 10; j represents an integer of from 0 to 4; and k represents an integer of from 2 to 6.

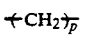

(B-1)

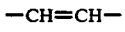

(B-2)

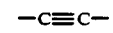

(B-3)

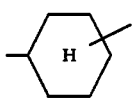

(B-4)

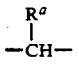

(B-5)

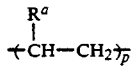

(B-6)

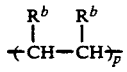

(B-7)

(wherein $R^b$s may be the same or different)

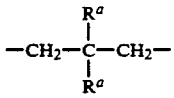

(B-8)

(wherein $R^b$s may be the same or different)

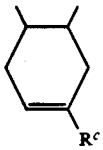

(B-9)

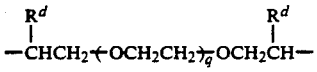

(B-10)

(wherein $R^b$s may be the same or different)

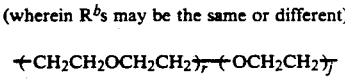

(B-11)

-continued

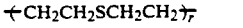

(B-12)

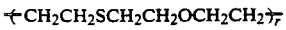

(B-13)

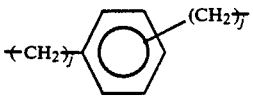

(B-14)

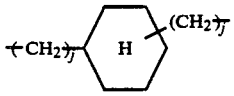

(B-15)

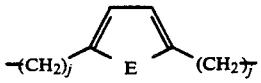

(B-16)

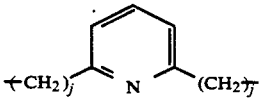

(B-17)

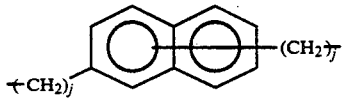

(B-18)

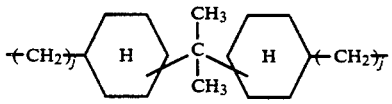

(B-19)

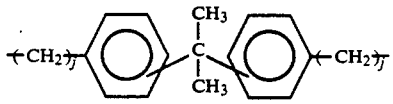

(B-20)

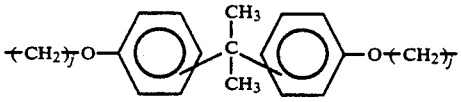

(B-21)

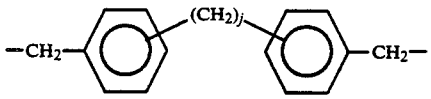

(B-22)

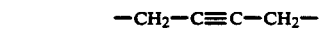

(B-23)

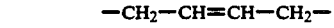

(B-24)

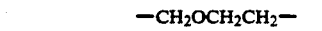

(B-25)

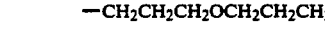

(B-26)

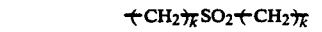

(B-27)

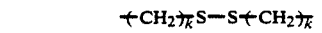

(B-28)

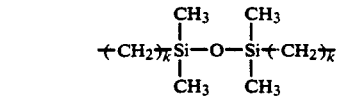

(B-29)

-continued (B-30)

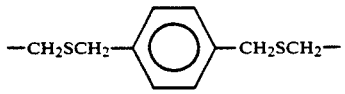

(B-31)

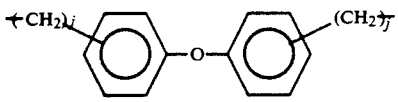

(B-32)

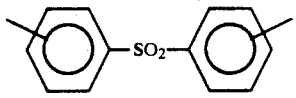

(B-33)

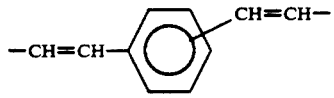

(B-34)

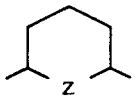

(B-35)

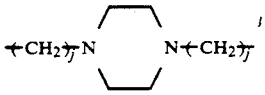

(B-36)

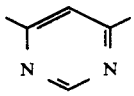

(B-37)

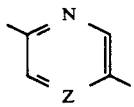

(B-38)

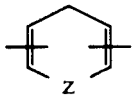

On the other hand, the copolymer component shown by aforesaid formula (III) is preferably incorporated in the comb-like copolymer (i.e., the dispersion-stabilizing resin) for use in this invention together with the copolymer component shown by formula (Ia) and/or the copolymer component shown by formula (Ib).

In formula (III) described above, $V^3$ represents —COO—, —OCO—, —O—, $-CH_2)_mCOO-$, $-CH_2)_mOCO-$, —CO—, or $-SO_2$ (wherein m represents an integer of from 1 to 3), and represents preferably —COO—, —OCO—, —O—, $-CH_2)_mCOO-$, or $-CH_2)_mOCO-$.

$R^3$ in the formula represents an alkyl group having at least 8 carbon atoms or an alkenyl group having at least 8 carbon atoms.

Specific examples of the alkyl group are octyl, nonyl, decyl, dodecyl, tridecyl, tetradecyl, hexadecyl, octadecyl, nonadecanyl, eicosanyl, and docosanyl.

Also, specific examples of the alkenyl group are octenyl, decenyl, dodecenyl, tetradecenyl, hexadecenyl, octadecenyl, and eicosenyl.

Also, $d^1$ and $d^2$, which may be the same or different, have the same meaning as $a^1$ and $a^2$ in formula (Ia). It is preferred that at least one of $d^1$ and $d^2$ represents a hydrogen atom.

The comb-like copolymer for use in this invention may further contain, together with the component shown by formula (Ia) and/or the component shown by formula (Ib) and the component shown by formula (III), other monomer(s) capable of copolymerizing with the monomers corresponding to the aforesaid components.

The content of such other monomer(s) is preferably less than 40% by weight of the total copolymer components.

Specific examples of such other monomer(s) are the monomers corresponding to the components shown by formula (III), wherein $R^3$ is a hydrocarbon group having not more than 12 carbon atoms (not more than 6 carbon atoms when the hydrocarbon group is an alkyl group, or an alkenyl group), which may be substituted, such as, for example, an alkyl group having from 1 to 6 carbon atoms, which may be substituted (e.g., methyl, ethyl, propyl, butyl, amyl, hexyl, 2-chloroethyl, 2-bromoethyl, 2-hydroxyethyl, 3-hydroxyethyl, 2,3-dihydroxypropyl, 3-chloro-2-hydroxypropyl, 3-bromopropyl, 2-(N,N-dimethylamino)ethyl, 2-methoxyethyl, 2-(4'-pyridyl)ethyl, 2-(N-morpholino)ethyl, 2-phenoxyethyl, 2-cyanoethyl, 2-methanesulfonylethyl, 2-(methoxycarbonyl)ethyl, 4-(methoxycarbonyl)butyl, 2-carboxyethyl, 2-phosphonoethyl, 2-thienylethyl, 2-pyranylethyl, 3-carboxyamidopropyl, 2,2,2-trifluoroethyl, 2,2,3,3-tetrafluoropropyl), and 3-phenylpropyl), an alkenyl group having from 3 to 6 carbon atoms, which may be substituted (crotonyl, butenyl, and hexenyl), an alicyclic group having from 5 to 12 carbon atoms (e.g., cyclopentyl, cyclohexyl, cyclohexenyl, cyclooctyl, cyclopentadienyl, and adamantyl), an aralkyl group having from 7 to 14 carbon atoms (e.g., benzyl, phenethyl, naphthylmethyl, naphthylethyl, bromobenzyl, chlorobenzyl, methylbenzyl, methoxybenzyl, dibromobenzyl, fluorobenzyl, ethoxycarbonylbenzyl, and cyanobenzyl), an aromatic group having from 6 to 12 carbon atoms (e.g., phenyl, tolyl, xylyl, mesityl, naphthyl, chlorophenyl, bromophenyl, fluorophenyl, dichlorophenyl, dibromophenyl, chloromethylphenyl, cyanophenyl, acetoxyphenyl, acetylphenyl, methoxycarbonylphenyl, acetylphenyl, methoxycarbonylphenyl, zpropylphenyl, biphenyl, butylphenyl, nonylphenyl, methoxyphenyl, butoxyphenyl, and N,N-diethylaminophenyl; unsaturated carboxylic acids (e.g., acrylic acid, methacrylic acid, crotonic acid, itaconic acid, and maleic acid) and amides of these carboxylic acids; itaconic anhydrides; maleic anhydrides; vinyl esters or allyl esters of an aliphatic carboxylic acid having from 1 to 6 carbon atoms; acrylonitrile; methacrylonitrile; styrene and the substitution products thereof (examples of the substituent are chlorine, bromine methyl, carboxy, sulfo, chloromethyl, hydroxymethyl, hydroxy, methoxymethyl, ethoxymethyl, N,N-dimethylaminomethyl, methoxycarbonyl, ethoxycarbonyl, and amide); vinylnaphthalene; and heterocyclic compounds having a polymerizable double bond group (e.g., vinylpyridine, vinylimidazoline, vinylthiophene, vinyldioxane, and vinylpyrrolidone).

The comb-like copolymer having a polymerizable double bond group at the terminal of the comb portion as described above can be produced by conventionally known synthesis methods.

For example, a typical method comprises synthesizing a macromonomer (M) represented by following formula (IIIa) or (IIIb), polymerizing the macromonomer (M) with the monomer shown by the aforesaid formula (III) to form a comb-like copolymer, and then introducing a polymerizable double bond group to —OH or —COOH at the terminal portion of the comb portion of the comb-like copolymer by a macromolecular reaction;

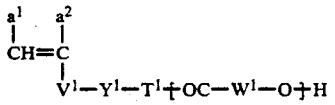

(IIIa)

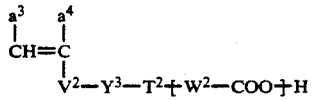

(IIIb)

wherein all symbols are the same as those in formulae (Ia) and (Ib).

The aforesaid macromonomer (M) shown by formula (IIIa) or (IIIb) can be easily produced by selectively introducing a polymerizable double bond group into a carboxy group or a hydroxy group only at one terminal of a polyester oligomer having a weight average molecular weight of from $1\times10^3$ to $2\times10^4$. That is, the polyester oligomer can be produced by a polycondensation reaction of a diol and a dicarboxylic acid, dicarboxylic acid anhydride, or a dicarboxylic acid ester, as described in *Kobunshi (Macromolecule) Data Handbook, Foundation,* edited by Kobunshi Gakkai, published by Baifukan, 1986.

The polyester oligomer can be synthesized by a conventionally known polycondensation reaction method such as, practically, the methods described in Eiichiro Takiyama, *Polyester Resin Handbook,* published by Nikkan Kogyo Shinbun Sha, 1980 and I. Goodman, *Encyclopedia of Polymer Science and Engineering,* Vol. 12, page 1, published by John Wiley & Sons, 1985.

A polymerizable double bond group can be introduced into a carboxy group only at one terminal of the polyester oligomer by a reaction of forming an ester from a carboxylic acid or a reaction of forming an ester from a carboxylic acid in low molecular compounds.

That is, the aforesaid macromonomer can be synthesized by a macromolecular reaction of the polyester oligomer and a compound having a polymerizable double bond group and a functional group capable of causing a chemical reaction with carboxy group (e.g.,

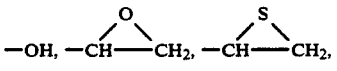

a halide (e.g., chloride, bromide, and iodide), —$NH_2$, or COOR' (wherein R' represents methyl, trifluoromethyl, and 2,2,2-trifluoroethyl)) in the molecule.

The aforesaid method is practically described in *Shin Jikken Kaqaku Koza (New Experimental chemistry Course),* 14, "Synthesis and Reaction of Organic Compounds [II]", Chapter 5, edited by Nippon Kagaku Kai, published by Maruzen K.K. and Yoshio Iwakura & Keisuke Kurita, *Hannosei Kobunshi (Reactive Macromolecules),* published by Kodansha, 1977.

Also, a polymerizable double bond group can be introduced to a hydroxy group only at one terminal of the polyester oligomer by a reaction of forming ester from an alcohol or a reaction of forming urethane from an alcohol in low molecular compounds.

That is, the aforesaid macromonomer is obtained by a method for esterifying an alcohol by the reaction with a carboxylic acid, a carboxylic acid ester, a carboxylic acid halide, or a carboxylic acid anhydride each having a polymerizable double bond group in the molecule or a reaction for forming a urethane by the reaction of an alcohol and a mono-isocyanate having a polymerizable double bond in the molecule.

Practical methods are described in *Shin Jikken Kagaku Koza (New Experimental Chemistry Course),* 14, "Synthesis and Reaction of Organic Compounds [II]", chapter 5, published by Maruzen K.K., 1977 and ibid., "Synthesis and Reaction of Organic Compounds [III]", page 1652, published by Maruzen K.K., 1978.

Also, for introducing a polymerizable double bond group by a macromolecular reaction into the comb-like copolymer having —OH or —COOH at the terminal of the comb portion obtained after a copolymerization reaction of the aforesaid macromonomer (M) and the monomer shown by formula (III), a conventional known reaction described above with respect to the macromonomer shown by formula (IIIa) may be used in the case of —OH, and a conventionally known reaction described above with respect to the macromonomer shown by formula (IIIb) may be used in the case of —COOH.

Also, the macromonomer shown by formula (IIIa) or (IIIb) can be synthesized using a carboxylic acid having a hydroxy group in the molecule as a starting material. That is, the macromonomer can be produced by a method for forming a polyester oligomer by a self-polycondensation reaction of the aforesaid carboxylic acid and then synthesizing the oligomer by the same macromolecular reaction as the aforesaid synthesis of the macromonomer, or a method for synthesizing the macromonomer by a living polymerization reaction of a carboxylic acid having a polymerizable double bond group and a lactone.

Practical methods are described in T. Yasuda, T. Aida, and S. Inoue, *J, Macromol. Sci. Chem.,* A, 21, 1035(1984), T. Yasuda, T. Aida and S. Inoue, *Macromolecules,* 17, 2217(1984), S. Sosnowski, S. Stomkowski and S. Penczek, *Makromol. Chem.,* 188, 1347(1987), Y. Gnanou and P. Rempp, *Makromol. Chem.,* 188, 2267(1987), and T. Shiota and Y. Goto, *J. Appl. Polym. Sci.,* 11, 753(1976).

Other methods for synthesizing the comb-like copolymer in this invention include a method comprising reacting a polymer including a copolymer component having —COOH or —OH and a lactone by a macromolecular reaction (the reaction shown by a reaction formula (1) described below) and then introducing a polymerizable double bond group into —COOH or —OH at the terminal of the comb portion of the product.

Reaction formula (1):

-continued

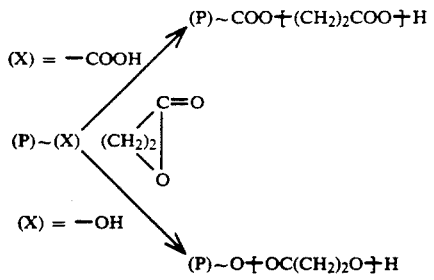

wherein (P) represents a polymer residual group.

The aforesaid method is practically described in R. P. Foss, H. W. Jacobsen, et al, *Macromolecules*, 9, 373 (1976) and W. H. Buck, *Rubber Chem. Technol.*, 50, 109 (1977).

Furthermore, as still another method for synthesizing the comb-like copolymer for use in this invention, there is also a method for synthesizing the macromonomer (M) shown by the aforesaid formula (IIIa) or (IIIb), previously introducing a polymerizable double bond group into —COOH or —OH at one terminal of the macromonomer (M) by the aforesaid method to form a di-functional macromonomer shown by formula (IVa) or (IVb), respectively, and polymerizing the macromonomer with a monomer corresponding to the component shown by formula (II-1) described above;

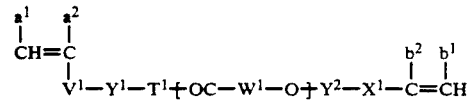

(IVa)

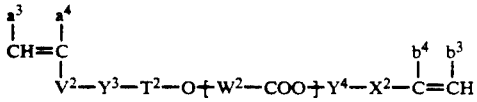

(IVb)

wherein all symbols are the same as those in formulae (Ia) and (Ib) described above.

However, the aforesaid method is limited in the case that there is a difference in the polymerization reactivity between the polymerizable double bond group shown by

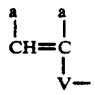

and that shown by

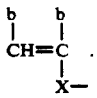

If the reactivity is the same between these double bond groups, a crosslinking reaction proceeds among the high molecular chains at the polymerization reaction to cause gelation. Practically, a combination of the polymerizable double bond groups described in JP-A-60-185962 can be used for the aforesaid method.

As the monomer (A) in this invention, any monofunctional monomers can be used as long as they are soluble in the aforesaid non aqueous solvent but become insoluble in the non-aqueous solvent by being polymerized. Specific examples thereof include a monomer represented by following formula (V):

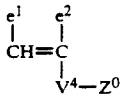

(V)

wherein $V^4$ represents —COO—, —OCO—, —$CH_2$OCO—, —$CH_2$COO—, —O—,

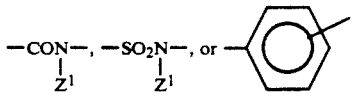

(wherein $Z^1$ represents an aliphatic group having from 1 to 18 carbon atoms, which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl).

In formula (V), $Z^0$ represents a hydrogen atom or an aliphatic group having from 1 to 6 carbon atoms, which may be substituted (e.g., methyl, ethyl, propyl, butyl, 2-chloroethyl, 2,2-dichloroethyl, 2,2,2-trifluoroethyl, 2-bromoethyl, 2-glycidylethyl, 2-hydroxyethyl, 2-hydroxypropyl, 2,3-dihydroxypropyl, 2-hydroxyy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl), 3-sulfamidopropyl, 2-N-methylcarboxyamidoethyl, cyclopentyl, chlorocyclohexyl, and dichlorohexyl).

Also, $e^1$ and $e^2$, which may be the same or different, each has the same meaning as $a^1$ and $a^2$ in formula (Ia) described above.

Specific examples of the monomer (A) are vinyl esters or allyl esters of an aliphatic carboxylic acid having from 1 to 6 carbon atoms (e.g., acetic acid, propionic acid, butyric acid, monochloroacetic acid, and trifluoropropionic acid); alkyl esters or alkyl amides (which may be substituted) of an unsaturated carboxylic acid such as acrylic acid, methacrylic acid, crotonic acid, itaconic acid, maleic acid, etc. (wherein the alkyl moiety has from 1 to 4 carbon atoms and examples of the alkyl group are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl), 2-benzenesulfonylethyl, 2-(N,N-dimethylamino)ethyl, 2-(N,N-diethylamino) ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2furfurylethyl, 2pyrdinylethyl, 2-thienethyl, trimethoxysilylpropyl, and 2-carboxyamidoethyl); styrene and styrene derivatives (e.g., vinyltoluene, α-methylstyrene, vinylnaphthalene, chlorostyrene, dichlorostyrene, bromostyrene, vinylbenzenecarboxylic acid, vinylbenzenesulfonic acid, chloromethylstryene, hydroxymethylstyrene, methoxymethylstryrene, N,N-dimethylaminomethylstyrene, vinylbenzencarboxyamide, and vinylbenzenesulfoamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile; and heterocyclic compounds having a polymerizable double bond group (practically, for example, the compounds described in *Kobunshi (Macromolecule) Data Handbook, Foundation,* pages 175 to 184, edited Kobunshi Gakki, published by Baifukan, 1986, such as N-vinylpyridine, N-vinylimidazoline, N-vinylpyrrolidone, vinylthiophene, vinyltetrahydrofuran, vinyloxazoline, vinylthiazole, N-vinylmorpholine, etc.).

The monomers (A) described above may be used singly or as a combination thereof.

Then, the monomer (B-1) shown by the aforesaid formula (II-1) for use in this invention is described in detail.

According to a preferred embodiment of this invention, the dispersion resin grains are obtained by copolymerizing a monomer (B-1) containing an aliphatic group having 8 or more carbon atoms with the monofunctional monomer (A) which is soluble in the aforesaid non-aqueous solvent but becomes insoluble by being solubilized.

Specific examples of the monomer (B-1) containing an aliphatic group having 8 or more carbon atoms include monomers represented by the following formula (II-1);

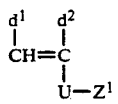

(II-1)

wherein $Z^1$ represents an aliphatic group having 8 or more carbon atoms; U represents —OCO—, —CONH—,

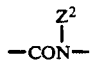

(wherein $Z^2$ represents an aliphatic group having from 1 to 32 carbon atoms), —OCO—, —$CH_2$COO— or —O—; and $d^1$ and $d^2$, which may be the same or different, each represents a hydrogen atom, an alkyl group, —$COOZ^3$, or —$CH_2$—$COOZ^3$ (wherein $Z^3$ represents an aliphatic group having from 1 to 32 carbon atoms).

In a preferred embodiment of the monomer shown by formula (II-1), $Z^1$ represents an alkyl group having a total carbon atoms of at least 10, which may be substituted, or an alkenyl group having a total carbon atoms of at least 10; U represents —COO—, —CONH—,

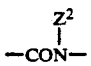

(wherein $Z^2$ represents preferably an aliphatic group having from 1 to 32 carbon atoms (wherein examples of the aliphatic group include an alkyl group, an alkenyl group or an aralkyl group), —OCO—, —$CH_2$OCO—, or —O—; and $d^1$ and $d^2$, which may be the same or different, each represents a hydrogen atom, a methyl group, —$COOZ^3$, or —$CH_2COOZ^3$ (wherein $Z^3$ represents preferably an alkyl group having from 1 to 32 carbon atoms, an alkenyl group, an aralkyl group, or a cycloalkyl group).

In a more preferred embodiment of formula (II-1), U represents —COO—, —CONH— or

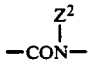

(wherein $Z^2$ is as defined above); $d^1$ and $d^2$, which may be the same or different, each represents a hydrogen atom or a methyl group; and $Z^1$ represents an aliphatic group having 8 or more carbon atoms.

Specific examples of the monomer (B-1) shown by formula (II-1) as described above are esters of an unsaturated carboxylic acid (such as, acrylic acid, methacrylic acid, crotonic acid, maleic acid, itaconic acid, etc.) having an aliphatic group having from 10 to 32 carbon atoms (wherein the aliphatic group may have a substituent such as a halogen atom, a hydroxy group, an alkoxy group, etc., or may have a hetero atom such as oxygen, sulfur, nitrogen, etc., in the carbon-carbon bond of the main chain thereof, and examples of the aliphatic group are decyl, dodecyl, tridecyl, tetradecyl, hexadecyl, octadecyl, docosanyl, decenyl, hexadecenyl, oleyl, linoleyl, and docosenyl); amides of the aforesaid carboxylic acids having an aliphatic group (wherein examples of the aliphatic group are the same as described above for the esters); vinyl esters or allyl esters of a higher aliphatic group (wherein examples of the higher aliphatic group are lauric acid, myristic acid, stearic acid, oleic acid, linolic acid, and behenic acid); and vinyl ethers substituted by an aliphatic group having from 10 to 32 carbon atoms (wherein examples of the aliphatic group are the same as the aforesaid aliphatic group of the unsaturated carboxylic acids).

According to the aforesaid embodiment, the dispersion resin grains in this invention are composed of at least one kind of the monomer (A) and at least one kind of the monomer (B-1). It is important that the resin synthesized from these monomers is insoluble in the aforesaid non-aqueous solvent, whereby the desired dispersion resin grains can be obtained.

More specifically, it is preferred that the monomer (B-1) shown by formula (II-1) is used in an amount of from 0.1 to 20% by weight to the monomer (A) being insolubilized, and the amount of the monomer (B-1) is more preferably from 0.3 to 8% by weight.

Also, the molecular weight of the dispersion resin grains for use in this invention is preferably from $1\times10^3$ to $1\times10^6$, and more preferably from $1\times10^4$ to $1\times10^6$.

The characteristic feature of the liquid developer for electrostatic photography of the aforesaid embodiment of this invention resides in an excellent redispersibility obtained by the use of the monomer (B-1) in combination with the monomer (A).

According to another preferred embodiment of this invention, the dispersion resin grains are obtained by copolymerizing a monomer (B-2) having at least two polar groups and/or polar linkage groups with the monofunctional monomer which is soluble in the aforesaid non-aqueous solvent but becomes insoluble therein by being polymerized.

Specific examples of the monomer (B-2) having at least two polar groups and/or polar linkage groups are monomers represented by following formula (II-2);

$$\begin{array}{l} d^3 \quad d^4 \\ | \quad\;\; | \\ CH{=}C \\ \qquad\;\; | \\ \qquad U\text{-}(A^1{-}B^1)_r\text{-}(A^2{-}B^2)_s\text{-}Z \end{array} \qquad \text{(II-2)}$$

wherein U represents —O—, —COO—, —OCO—, —$CH_2OCO$—, —$SO_2$—, —CONH—, —$SO_2NH$—, $$-\overset{Z^1}{\overset{|}{C}}ON-,\ \text{or}\ -SO_2\overset{Z^1}{\overset{|}{N}}-$$

(wherein $Z^1$ represents a hydrocarbon group or represents the same linkage group as $-A^1-B^1)_r(A^2-B^2)_sZ$ in aforesaid formula (II-2).

Z represents a hydrogen atom or a hydrocarbon group having from 1 to 18 carbon atoms, which may be substituted with a halogen atom, —OH, —CN, —$NH_2$, —COOH, —$SO_3H$ or —$PO_3H_2$.

$B^1$ and $B^2$, which may be the same or different, each represents —O—, —S—, —CO—, —$CO_2$—, —OCO—, —$SO_2$—, $$-\overset{Z^2}{\overset{|}{N}}-,\ -\overset{Z^2}{\overset{|}{C}}ON-,\ -\overset{Z^2}{\overset{|}{N}}CO-,\ -\overset{Z^2}{\overset{|}{N}}SO_2-,$$

$$-SO_2\overset{Z^2}{\overset{|}{N}}-,\ -NHCO_2-,\ \text{or}\ -NHCONH-$$

(wherein $Z^2$ has the same meaning as Z described above).

$A^1$ and $A^2$, which may be the same or different, each represents a hydrocarbon group having from 1 to 18 carbon atoms having from 1 to 18 carbon atoms, which may be substituted or may contain, in the main chain bond, a group $$\begin{array}{l} -CH- \\ \quad\;\; | \\ B^3\text{-}(A^4{-}B^4)_t\text{-}Z^3 \end{array}$$

(wherein $B^3$ and $B^4$, which may be the same or different, have the same meaning as $B^1$ and $B^2$ described above; $A^4$ represents a hydrocarbon group having from 1 to 18 carbon atoms, which may be substituted; and $Z^3$ has the same meaning as $Z^1$ described above).

Also, $d^3$ and $d_4$, which may be the same or different, each represents a hydrogen atom, —COO—$Z^4$, or —COO—$Z^4$ bonded via a hydrocarbon group (wherein $Z^4$ represents a hydrogen atom, or a hydrocarbon group which may be substituted.

Furthermore, r, s, and t, which may be the same or different, each represents an integer of from 0 to 4 with the proviso that r, s, and t cannot be 0 at the same time.

The monomer (B-2) represented by formula (II-2) used in the present invention is described hereinafter in detail.

In formula (II-2) described above, U represents preferably —O—, —COO—, —OCO—, —$CH_2OCO$—, —CONH—, or $$-\overset{Z^1}{\overset{|}{C}}ON-$$

(wherein $Z^1$ represents preferably an alkyl group having from 1 to 16 carbon atoms which may be substituted, an alkenyl group having from 2 to 16 carbon atoms which may be substituted, an alicyclic group having from 5 to 18 carbon atoms which may be substituted, or has the same meaning as the linkage group, $-A^1-B^1)_r$ $(A^2-B^2)_s$ Z in formula (II-2)).

Z represents preferably a hydrogen atom or an aliphatic group having from 1 to 16 carbon atoms which may be substituted with a halogen atom (e.g., chlorine and bromine), —OH, —CN, or —COOH wherein examples of the aliphatic group are an alkyl group, an alkenyl group, or an aralkyl group.

$B^1$ and $B^2$, which may be the same or different, each represents preferably —O—, —S—, —CO—, —COO—, —OCO—, $$-\overset{Z^2}{\overset{|}{C}}ON-,\ \text{or}\ -\overset{Z^2}{\overset{|}{N}}CO-$$

(wherein $Z^2$ has the same meaning as Z described above).

$A^1$ and $A^2$, which may be the same or different, each represents preferably a hydrocarbon group having from 1 to 12 carbon atoms which may be substituted or may have a group $$\begin{array}{l} -CH- \\ \quad\;\; | \\ B^3\text{-}(A^4{-}B^4)_t\text{-}Z^3 \end{array}$$

in the main chain bond wherein examples of the hydrocarbon group are an alkylene group, an alkenylene group, an arylene group, or a cycloalkylene group. In the above group, $B^3$ and $B^4$, which may be the same or different, have the same meaning as $B^1$ and $B^2$ described above; $A^3$ represents preferably an alkylene group having from 1 to 12 carbon atoms, an alkenylene group or an arylene group each may be substituted; and $Z^3$ has the same meaning as Z described above.

Also, $d^3$ and $d^4$, which may be the same or different, each represents preferably a hydrogen atom, a methyl group, —COO—$Z^4$, or —$CH_2COO$—$Z^4$ (wherein $Z^4$ represents preferably a hydrogen atom, an alkyl group having from 1 to 18 carbon atoms, an alkenyl group having from 3 to 18 carbon atoms, an aralkyl group having from 7 to 18 carbon atoms, or a cycloalkyl group having from 5 to 18 carbon atoms).

Furthermore, r, s, and t, which may be the same or different, each represents preferably 0, 1, 2, or 3, with the proviso that r, s, and t cannot be 0 at the same time.

More preferably, U in formula (II-2) represents —COO—, —CONH—, or $$-\overset{Z^1}{\overset{|}{C}}ON-;$$

$d^3$ and $d^4$, which may be the same or different, each represents a hydrogen atom, a methyl group, —COO—$Z^4$ or —$CH_2COO$—$Z^4$ (wherein $Z^4$ represents more preferably an alkyl group having from 1 to 12 carbon atoms).

Also, in formula (II-2), $A^1$ and $A^2$, each is practically composed of an optional combination of atomic groups such as

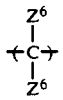

(wherein $Z^6$ and $Z^7$ each represents a hydrogen atom, an alkyl group, a halogen atom, etc.),

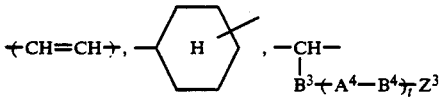

(wherein $B^3$, $B^4$, $Z^3$, and t are the same as those described above).

Also, it is preferred that, in the linkage group

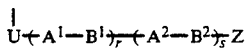

in formula (II-2), the total number of atoms in the linkage main chain composed of U, $A^1$, $B^1$, $A^2$, $B^2$ and Z is at least 8. In this case, when U represents

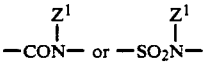

and $Z^1$ represents $—A^1—B^1)_r(A^2—B^2)_sZ$, the linkage main chain composed of $Z^1$ is also included in the aforesaid linkage main chain.

Furthermore, when $A^1$ and $A^2$ are hydrocarbon groups having

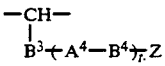

in the main chain thereof, $—B^3—A^4—B^4)_tZ^3$ is also included in the aforesaid linkage main chain.

As to the number of atoms of the linkage main chain, when U represents —COO— or —CONH—, the oxo group (=O) and the hydrogen atom are not included in the number of atoms, and the carbon atom, the ether-type oxygen atom, and the nitrogen atom are included in the number of atoms. Thus, the number of atoms of —COO— or —CONH— is counted as 2. Similarly, when Z represents $—C_9H_{19}$, the hydrogen atoms are not included in the atom number and the carbon atoms are included. Thus, the number of atoms of $—C_9H_{19}$ is counted as 9.

Then, specific examples of the monomer (II-2) are illustrated below.

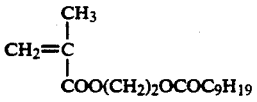

(II-2-1)

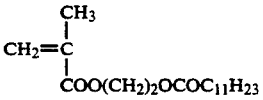

(II-2-2)

-continued

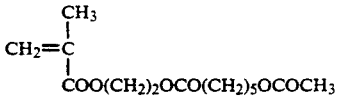

(II-2-3)

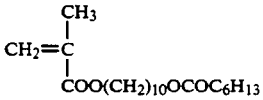

(II-2-4)

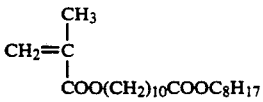

(II-2-5)

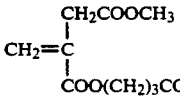

(II-2-6)

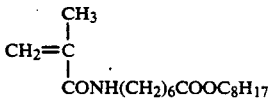

(II-2-7)

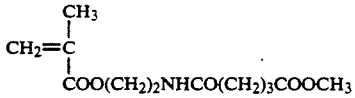

(II-2-8)

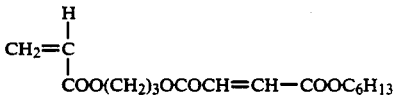

(II-2-9)

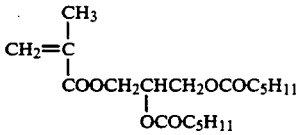

(II-2-10)

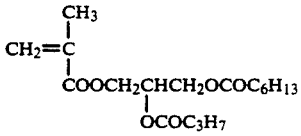

(II-2-11)

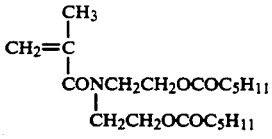

(II-2-12)

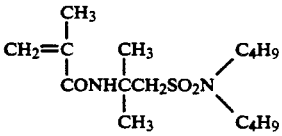

(II-2-13)

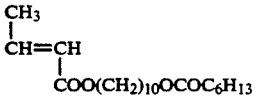

(II-2-14)

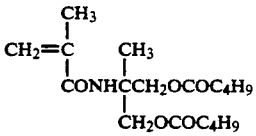

(II-2-15)

-continued (II-2-16)

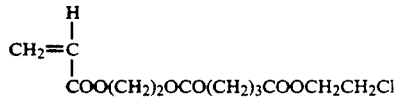

(II-2-17)

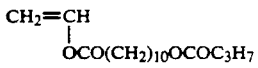

(II-2-18)

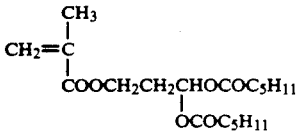

(II-2-19)

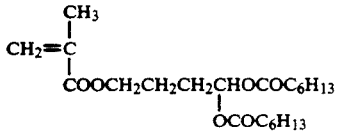

(II-2-20)

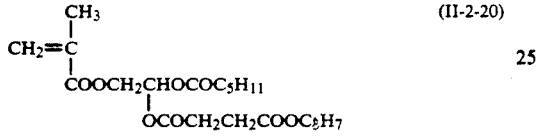

(II-2-21)

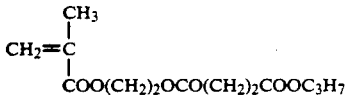

(II-2-22)

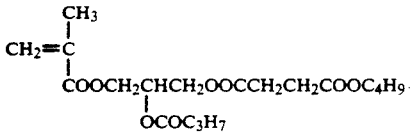

(II-2-23)

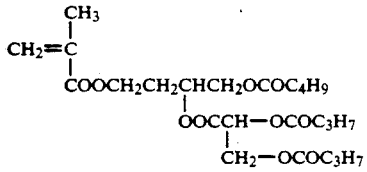

(II-2-24)

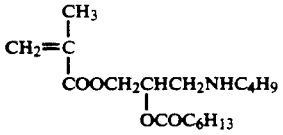

(II-2-25)

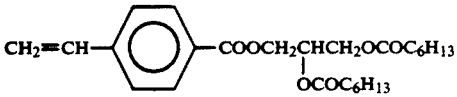

(II-2-26)

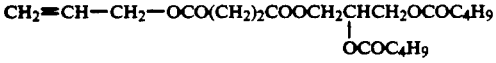

(II-2-27)

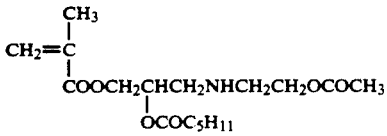

-continued (II-2-28)

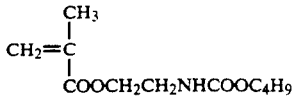

(II-2-29)

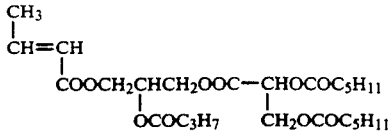

According to the aforesaid embodiment of this invention, the dispersion resin grains used in this invention are composed of at least one kind of the monomer (A) and at least one kind of the monomer (B-2) and, in this case, it is also important that the resin formed from these monomers is insoluble in the aforesaid non-aqueous solvent, whereby the desired dispersion resin grains can be obtained.

More practically, the amount of the monomer (II-2) used is preferably from 0.1 to 10% by weight and more preferably from 0.2 to 8% by weight to the amount of the monomer (A) being insolubilized. Also, the molecular is preferably from $1\times10^3$ to $1\times10^6$, and more preferably from $1\times10^4$ to $1\times10^6$.

The characteristic feature of the liquid developer for electrostatic photography in the aforesaid embodiment resides in an excellent fixing property while keeping the good re dispersibility by the use of the monomer (B-2).

The dispersion resin grains used in this invention as described above can be generally produced by heat-polymerizing the aforesaid dispersion-stabilizing resin, the monomer (A), and, if necessary, the monomer (B-1) or (B-2) in a non-aqueous solvent in the presence of a polymerization initiator such as benzyl peroxide, azobisisobutylonitrile, butyl lithium, etc.

Practically, the dispersion resin grains can be produced by (1) a method comprising adding the polymerization initiator to a solution of the dispersion-stabilizing resin, the monomer (A), and, if necessary, the monomer (B-1) or (B-2), (2) a method comprising adding dropwise the monomer (A) and, if necessary, the monomer (B-1) or (B-2) together with the polymerization initiator to a solution of the dispersion-stabilizing resin, (3) a method comprising forming a solution of the dispersion-stabilizing resin and a part of the monomer (A) and, if necessary, a part of the monomer (B-1) or (B-2) and adding the remaining monomer (A) and, if necessary, monomer (B-1) or (B-2) to the solution together with the polymerization initiator, or (4) a method comprising adding a solution of the dispersion-stabilizing resin, the monomer (A), and, if necessary, the monomer (B-1) or (B-2) to a non-aqueous solvent together with the polymerization initiator.

The total amounts of the monomer (A) and, if necessary, the monomer (B-1) or (B-2) are from 5 to 80 parts by weight, and preferably from 10 to 50 parts by weight per 100 parts by weight of the non aqueous solvent.

The proportion of the soluble resin which is the dispersion-stabilizing resin is from 1 to 100 part by weight, and preferably from 5 to 50 parts by weight per 100 parts by weight of the total monomers.

The proper amount of the polymerization initiator is from 0.1 to 5% by weight of the amount of the total monomers.

The polymerization temperature is from about 50° to 180° C., and preferably from 60° to 120° C. and the reaction time is preferably from 1 to 15 hours.

When the aforesaid polar solvent such as an alcohol, an ether, an ester, etc., is used in the non-aqueous solvent at the reaction and unreacted monomers (a) and, if used, (B-1) or (B-2) remain without being polymerization granulated, it is preferred to remove the polar solvent and/or the monomers by heating to the boiling point of the monomers or by distillation under reduced pressure.

The molecular weight of the dispersion resin grains is from $1\times10^3$ to $1\times10^6$, and preferably from $1\times10^4$ to $1\times10^6$.

The non-aqueous system dispersion resin grains thus produced as described above exist as fine grains having a uniform grain size distribution and show a very stable dispersibility. In particular, when the liquid developer containing the dispersed resin grains is used repeatedly in a developing apparatus for a long period of time, the resin grains keep the good dispersibility and further, when the developing speed is increased, the resin grains can be easily re-dispersed and no staining on each part of the developing apparatus by adhesion of the resin grains is observed.

Also, when the resin grains are fixed by heating, etc., a strong film or coating is formed, which shows an excellent fixing property of the resin.

Furthermore, the liquid developer of this invention is excellent in dispersibility, re-dispersibility, and fixing property even when the developing-fixing steps are quickened and large-size master plates are used for making printing plates.

The liquid developer for electrophotography of this invention may contain, if desired, a coloring agent. As the coloring agent, various pigments or dyes can be used.

In coloring the dispersion resin grains, a typical method for coloration comprises physically dispersing a pigment or a dye in the dispersion resin. Various pigments and dyes are known for this purpose, and examples thereof include a ferromagnetic iron oxide powder, powdered lead iodide, carbon black, nigrosine, Alkali Blue, Hanza Yellow, Quinacridone, and Phthalocyanine Blue.

Another method for coloring the dispersion resin, comprises dyeing the dispersion resin with a dye as described in JP-A 57-48738. Also, as other methods, there are a method of chemically bonding the dispersion resin and a dye as disclosed in JP-A-53-54029 and a method of using a monomer previously containing a dye at the production of the copolymer by a polymerization granulation to form a copolymer containing the dye as described in JP-B-44-22955.

The liquid developer of this invention may further contain, if desired, various additives for improving the charging characteristics and image characteristics as described, for example, in Yuji Harasaki, *Denshi Shashin* (*Electrophotography*), Vol. 16, No. 2, page 44.

Examples of such additives include metal salts of di-2-ethylhexylsulfosuccinic acid, metal salts of naphthenic acid, metal salts of a higher fatty acid, lecitine, poly(vinylpyrrolidone), and a copolymer containing a half maleic acid amide component.

Then, the amounts of the main components of the liquid developer of this invention are explained below.

The amount of the toner grains (resin grains) mainly composed of the resin and, if desired, a coloring agent is preferably from 0.5 to 50 parts by weight per 1,000 parts by weight of the carrier liquid.

If the amount is less than 0.5 part by weight, the image density is insufficient, while if the amount is over 50 parts by weight, fog is liable to form on non-image portions.

Furthermore, the aforesaid dispersion-stabilizing resin which is soluble in the carrier liquid can be used, if desired, in an amount of from about 0.5 to 100 parts by weight per 1,000 parts by weight of the carrier liquid.

Also, a charge controlling agent may be used in an amount of preferably from 0.001 to 1.0 part by weight per 1,000 parts by weight of the carrier liquid.

Moreover, if desired, various additives may be added, and the upper limit of the total amount of these additives is regulated by the electric resistance of the liquid developer obtained. That is, if the electric resistance of the liquid developer excluding the toner grains is lower than $10^9\ \Omega$ cm, images having good continuous tone is difficult to obtain and, hence, it is necessary to control the addition amount of each additive within the aforesaid limit.

The following examples are intended to illustrate the embodiment of this invention in detail but the scope of this invention is not limited thereto.

SYNTHESIS EXAMPLE 1 OF MACROMONOMER: MM-1

A mixture of 90.1 g of 1,4-butandiol, 105.1 g of succinic anhydride, 1.6 g of p-toluenesulfonic acid monohydrate, and 200 g of toluene was refluxed in a flask equipped with a Dean-Stark refluxing apparatus with stirring for 4 hours. The amount of water azeotropically distilled off together with toluene was 17.5 g.

Then, after adding a mixture of 17.2 g of acrylic acid and 150 g of toluene to the aforesaid reaction mixture together with 1.0 g of t-butylhydroquinone, the reaction was carried out under refluxing with stirring for 4 hours. After cooling to room temperature, the reaction mixture was reprecipitated from 2 liters of methanol, and the precipitated solids were collected by filtration and dried at reduced pressure to obtain 135 g of a macromonomer MM-1 having a weight average molecular weight of $6.8\times10^3$.

Macromonomer MM-1:

$$CH_2{=}CH{-}COO[(CH_2)_4OCO{-}CH_2)_2COO{-}H$$

SYNTHESIS EXAMPLE 2 OF MACROMONOMER: MM-2

A mixture of 120 g of 1,6-hexanediol, 114.1 g of glutaric anhydride, 3.0 g of p-toluenesulfonic acid monohydrate, and 250 g of toluene was reacted under the same condition as described in Synthesis Example 1 of macromonomer. The amount of water azeotropically distilled off was 17.5 g. After cooling to room temperature, the reaction mixture was reprecipitated from 2 liters of n-hexane, and the resulting liquid material was collected by decantation and dried under reduced pressure.

The reaction product thus obtained was dissolved in toluene, and the content of the carboxy group was determined by a neutralization titration with a methanol solution of 0.1 N potassium hydroxide and was found to be 500 μmol/g.

A mixture of 100 g of the aforesaid solid product, 8.6 g of methacrylic acid, 1.0 g of t-butylhydroquinone and 200 g of methylene chloride was stirred at room temperature to form a solution. To the solution was added dropwise a mixture of 20.3 g of dicyclohexylcarbodiimide (D.C.C.), 0.5 g of 4-(N,N-dimethylamino)pyridine and 100 g of methylene chloride with stirring over a period of one hour. The resulting mixture was stirred for 4 hours in situ. Upon dropwise addition of the solution of D.C.C., insoluble crystals were precipitated.

The reaction mixture was passed through a 200 mesh nylon cloth to remove insoluble materials. Then, the resulting filtrate was reprecipitated from 2 liters of hexane and the precipitated powdery solid was collected by filtration. After adding thereto 500 ml of acetone followed by stirring for one hour, insoluble materials were filtered off using a filter paper. After concentrating the filtrate under reduced pressure to a volume of ½ the original volume, the concentrate was added to one liter of diethyl ether, and the mixture was stirred for one hour. The precipitated solids thus formed were collected by filtration and dried under reduced pressure to obtain 53 g of a macromonomer MM-2 having a weight average molecular weight of $8.2\times10^3$.

Macromonomer MM-2:

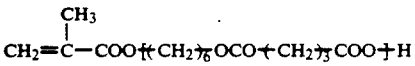

SYNTHESIS EXAMPLE 3 OF MACROMONOMER: MM-3

By following the same procedure as Synthesis Example 2 of macromonomer MM-2 except that 13.0 g of 2-hydroxyethylmethacrylic acid was used in place of 8.6 g of methacrylic acid, a macromonomer MM-3 was obtained. The amount of the product was 50 g and the weight average molecular weight thereof was $8.5\times10^3$.

Macromonomer MM-3:

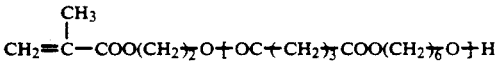

SYNTHESIS EXAMPLE 4 OF MACROMONOMER: MM-4

In an oil bath having an external temperature of 150° C., 500 g of 12-hydroxystearic acid was stirred for 10 hours under reduced pressure of from 10 to 15 mmHg while distilling off water being formed. The content of carboxy group of the liquid product (oligoester) obtained was 600 μmol/g.

A mixture of 100 g of the aforesaid liquid product, 18.5 g of methacrylic anhydride, 1.5 g of t-butylhydroquinone and 200 g of tetrahydrofuran was stirred for 6 hours at a temperature of from 40° to 45° C. The reaction mixture obtained was added dropwise to one liter of water with stirring over a period of one hour and then was further stirred for one hour. After allowing the mixture to stand, the precipitated liquid product thus obtained was recovered by decantation, dissolved in 200 g of tetrahydrofuran, and then the solution obtained was reprecipitated from one liter of methanol. The liquid product thus precipitated was recovered by decantation and dried under reduced pressure to obtain 62 g of a macromonomer MM-4 having a weight average molecular weight of $6.7\times10^3$.

Macromonomer MM-4:

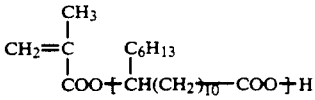

SYNTHESIS EXAMPLE 5 OF MACROMONOMER: MM-5

By following the same procedure as described in Synthesis Example 2 of macromonomer MM-2 using D.C.C. as a condensing agent except that a mixture of 100 g of the oligoester obtained as an intermediate in Synthesis Example 4 of macromonomer MM-4, 15.6 g of 2-hydroxyethyl methacrylate, 1.5 g of t-butylhydroquinone, and 200 g of methylene chloride was used, a product (macromonomer MM-5) was obtained.

Macromonomer MM-5:

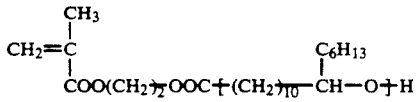

Weight average molecular weight: $6.5\times10^3$

SYNTHESIS EXAMPLE 6 OF MACROMONOMER: MM-6

According to the synthesis method described in S. Penczek et al., *Makromol. Chem.*, 188, 1347(1987), a macromonomer MM-6 having the following structure was synthesized.

Macromonomer MM-6:

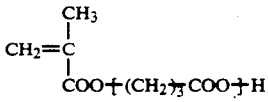

Weight average molecular weight: $7.3\times10^3$

SYNTHESIS EXAMPLE 1 OF DISPERSION-STABILIZING RESIN: P-1

A mixed solution of 70 g of octadecyl methacrylate, 30 g of macromonomer MM-2 and 150 g of toluene was heated to 75° C. under nitrogen gas stream and, after adding 1.0 g of 2,2'-azobis(isobutylonitrile) (A.I.B.N.) to the reaction mixture, the reaction was carried out for 4 hours. Then, after adding 0.5 g of A.I.B.N. to the reaction mixture, the reaction was carried out for 3 hours and, after further adding thereto 0.3 g of A.I.B.N., the reaction was carried out for 3 hours.

After cooling the resulting reaction mixture to 25° C., 2.2 g of allyl alcohol was added thereto, and the mixture was stirred. Then, a mixture of 4.0 g of D.C.C., 0.2 g of N,N-dimethylaminopyridine and 50 g of methylene chloride was added dropwise to the aforesaid mixture over a period of one hour, and then the reaction was carried out for 4 hours as it was. Then, after adding thereto 2 ml of formic acid followed by stirring for one hour, crystals precipitated were filtered off, and the filtrate formed was reprecipitated from 2 liters of methanol. The precipitated powdery solid product was collected by filtration and dissolved in 150 ml of tetrahydrofuran. The solution was then reprecipitated from one liter of methanol, and the precipitated powdery solid product was collected by filtration and dried under reduced pressure. When the powder thus obtained was tested for the unreacted carboxy group in the polymer in a methanol solution of 0.1 N potassium hydroxide as described in Synthesis Example 2 of macromonomer MM-2, no carboxy group was detected. The amount of the product (dispersion-stabilizing resin P-1) obtained was 62 g and the weight average molecular weight thereof was $4.2\times10^4$.

Dispersion-stabilizing resin P-1:

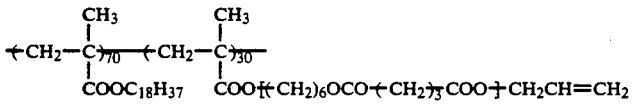

SYNTHESIS EXAMPLES 2 to 15 OF DISPERSION-STABILIZING RESIN: P-2 to P-15

By following the same procedure as Synthesis Example 1 of P-1 while changing octadecyl methacrylate and the macromonomer MM-2, each of the dispersion-stabilizing resins P-1 to P-15 shown in Table 1 below was synthesized. The weight average molecular weights of these resins were from $3.5\times10^4$ to $4.5\times10^4$.

TABLE 1

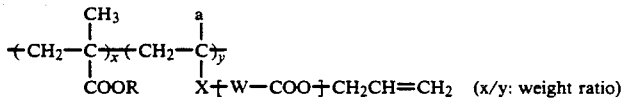

(x/y: weight ratio)

| Synthesis Example | Dispersion-Stabilizing Resin | R | x/y | a | —X— | —W— |
|---|---|---|---|---|---|---|
| 2 | P-2 | $-C_{16}H_{33}$ | 60/40 | $-CH_3$ | —COO— | $+CH_2)_6OCO(CH_2)_3$ |
| 3 | P-3 | $-C_{14}H_{29}$ | 60/40 | " | $-COO(CH_2)_2COO-$ | $+CH_2)_4OCO(CH_2)_3$ |
| 4 | P-4 | $-C_{13}H_{27}$ | 70/30 | " | —COO— | $-CH_2C(CH_3)_2-CH_2OCO(CH_2)_3$ |
| 5 | P-5 | $-C_{12}H_{25}$ | 80/20 | " | —COO— | $-CH_2C(C_2H_5)_2-CH_2OCO(CH_2)_2$ |
| 6 | P-6 | $-C_{12}H_{25}$ | 60/40 | —H | —COO— | $-CH(C_6H_{13})+CH_2)_{10}$ |
| 7 | P-7 | $-C_{18}H_{37}$ | 80/20 | $-CH_3$ | $-COO(CH_2)_2OCO(CH_2)_2COO-$ | $+CH_2)_{12}$ |
| 8 | P-8 | $-C_{18}H_{37}$ | 80/20 | —H | 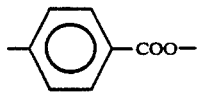 | $-CH_2C(C_2H_5)_2-CH_2OCO(CH_2)_3$ |
| 9 | P-9 | $-C_{13}H_{27}$ | 75/25 | —H | $-COO(CH_2)_2COO-$ | $+CH_2)_{16}$ |
| 10 | P-10 | $-C_{10}H_{21}$ | 80/20 | $-CH_3$ | $-COO(CH_2)_2OCO(CH_2)_3COO-$ | $-CH(C_6H_{13})+CH_2)_{10}$ |
| 11 | P-11 | $-C_{18}H_{37}$ | 85/15 | $-CH_3$ | " | $-CH_2C(CH_3)_2-$ |
| 12 | P-12 | " | 80/20 | " | $-COO(CH_2)_6COO-$ | $+CH_2)_3OCOCH_2CH(CH_3)-$ |
| 13 | P-13 | " | 90/10 | " | " | 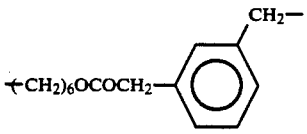 |

TABLE 1-continued $$\left(CH_2-\underset{\underset{COOR}{|}}{\overset{\overset{CH_3}{|}}{C}}\right)_x\left(CH_2-\underset{\underset{X+W-COO+CH_2CH=CH_2}{|}}{\overset{\overset{a}{|}}{C}}\right)_y \quad \text{(x/y: weight ratio)}$$

| Synthesis Example | Dispersion-Stabilizing Resin | R | x/y | a | —X— | —W— |
|---|---|---|---|---|---|---|
| 14 | P-14 | $-C_{18}H_{37}$ | 80/20 | —H | 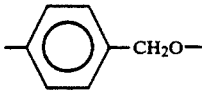 | $-CH_2CH(C_4H_9)CH_2OCO(CH_2)_5-$ |
| 15 | P-15 | $-C_{12}H_{25}$ | 85/15 | $-CH_3$ | $-COO(CH_2)_2NHCO(CH_2)_3COO-$ | $-CH(C_4H_9)(CH_2)_{10}-$ |

SYNTHESIS EXAMPLES 16 to 23 OF DISPERSION-STABILIZING RESIN: P-16 to P-23

By following the same procedure as Synthesis Example 1 of P-1 except that each of the hydroxy group-containing monomers corresponding to the resins shown in Table 2 below was used in place of allyl alcohol, each of dispersion-stabilizing resins P-16 to P-23 was synthesized. The weight average molecular weights of the resins were from $4.0\times10^4$ to $4.5\times10^4$.

TABLE 2

$$\left(CH_2-\underset{\underset{COOC_{18}H_{37}}{|}}{\overset{\overset{CH_3}{|}}{C}}\right)_{70}\left(CH_2-\underset{\underset{COO(CH_2)_6OCO(CH_2)_3COO+R}{|}}{\overset{\overset{CH_3}{|}}{C}}\right)_{30}$$

| Synthesis Example | Dispersion-stabilizing Resin | —R |
|---|---|---|
| 16 | P-16 | $(CH_2)_2OOC-CH=CH_2$ |
| 17 | P-17 | $(CH_2)_2OOC-C(CH_3)=CH_2$ |
| 18 | P-18 | $(CH_2)_2OOC-CH=CH(CH_3)$ |
| 19 | P-19 | 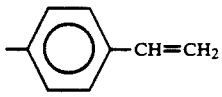 |
| 20 | P-20 | $(CH_2)_2OOC-CH_2CH=CH_2$ |
| 21 | P-21 | $(CH_2)_2NHCOCH=CH_2$ |
| 22 | P-22 | $(CH_2)_4NHCOC(CH_3)=CH_2$ |
| 23 | P-23 | $(CH_2)_2OOC(CH_2)_2SO_2CH=CH_2$ |

SYNTHESIS EXAMPLES 24 OF DISPERSION-STABILIZING RESIN: P-24

A mixture of 60 g of octadecyl methacrylate, 20 g of butyl methacrylate, 20 of the macromonomer MM-1 and 150 g of toluene was heated to 70° C. under nitrogen gas stream and, after adding 1.0 g of A.I.B.N. to the reaction mixture, the reaction was carried out for 4 hours. Then, after adding 0.5 g of A.I.B.N. to the reaction mixture, the reaction was carried out for 2 hours and, after further adding thereto 0.5 g of A.I.B.N., the reaction was carried out for 3 hours at 90° C.

Then, 3.2 g of vinyl acetate, 0.2 g of mercury acetate, and 1.0 g of t-butylhydroquinone were added to the reaction mixture, and the reaction was carried out for 10 hours at 80° C. After cooling the reaction mixture to room temperature, 10 ml of an aqueous solution of 1 N sulfuric acid was added thereto followed by stirring for one hour, and the solution formed was reprecipitated from 2 liters of methanol. The precipitated powdery solid product was collected by filtration, dissolved in 200 ml of methylene chloride, and the solution was reprecipitated again from one liter of methanol. The precipitated powdery solid product was collected by filtration and dried under reduced pressure to obtain 58 g of a dispersion-stabilizing resin P-24 having a weight average molecular weight of $5.3\times10^4$.

Dispersion-stabilizing resin P-24:

$$\left(CH_2-\underset{\underset{COOC_{18}H_{37}}{|}}{\overset{\overset{CH_3}{|}}{C}}\right)_{60}\left(CH_2-\underset{\underset{COOC_4H_9}{|}}{\overset{\overset{CH_3}{|}}{C}}\right)_{20}\left(CH_2-\underset{\underset{COO(CH_2)_4OCO(CH_2)_2COO+CH=CH_2}{|}}{CH}\right)_{20}$$

SYNTHESIS EXAMPLES 25 OF DISPERSION-STABILIZING RESIN: P-25

In synthesis Example 1 of P-1, 5.5 g of glycidyl methacrylate, 0.3 g of N,N-dimethylaminoaniline, and 1.0 g of t-butylhydroquinone were added to the toluene solution of a copolymer of octadecyl metacrylate/macromonomer MM-2 (70/30) obtained as intermediate product, and the reaction was carried out for 20 hours at 110° C.

After cooling, the reaction mixture was reprecipitated from 2 liters of methanol, the precipitated powdery solid product was collected by filtration and dissolved in 150 ml of methylene chloride. The solution formed was reprecipitated again in one liter of methanol and the powdery solid product precipitated was collected by filtration and dried under reduced pressure. When the percent reaction was determined by measuring the amount of remaining carboxy groups in the polymer with a methanol solution of 0.1 N potassium hydroxide, the conversion was 98.5%.

Thus, 68 g of a copolymer (dispersion-stabilizing resin P-25) having a weight average molecular weight of $4.8\times10^4$ was obtained.

Dispersion-stabilizing resin P-25:

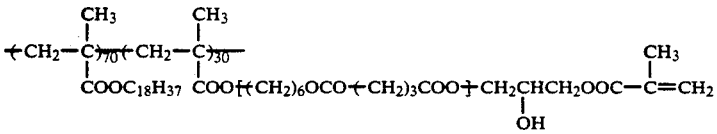

SYNTHESIS EXAMPLES 26 to 28 OF DISPERSION-STABILIZING RESIN: P-26 to P-28

By reacting the carboxy group in the comb-like polymer and each monomer having an epoxy group as in Synthesis Example 25 of P-25, each of dispersion-stabilizing resins P-26 to P-28 in Table 3 below was synthesized. The weight average molecular weights of these resins were from $3.0\times10^4$ to $5\times10^4$.

TABLE 3

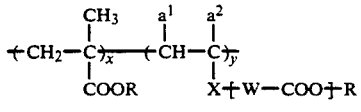

(x/y: weight ratio)

| Synthesis Example | Dispersion-stabilizing Resin | —R | x/y | $a^1/a^2$ | —X— | —W— | —R |
|---|---|---|---|---|---|---|---|
| 26 | P-26 | $-C_{12}H_{25}$ | 80/20 | H/$CH_3$ | —COO— | $-(CH_2)_3OCO(CH_2)_3-$ | $-CH_2CH(OH)CH_2OOC-CH=CH_2$ |
| 27 | P-27 | $-C_{16}H_{33}$ | 60/40 | H/$CH_3$ | " | $-CH_2CH(C_6H_{13})CH_2OCO(CH_2)_2-$ | $-CH_2CH(OH)CH_2CH=CH_2$ |
| 28 | P-28 | $-C_{18}H_{37}$ | 70/30 | H/H | $-COO(CH_2)_2COO-$ | $-(CH_2)_3-$ | " |

SYNTHESIS EXAMPLES 29 to 34 OF DISPERSION-STABILIZING RESIN: P-29 to P-34

By following the same procedure as Synthesis Example 1 of P-1 except that each of monomers corresponding to the resins shown in Table 4 below was used in place of 70 g of octadecyl methacrylate, each of dispersion-stabilizing resins P-29 to P-34 was synthesized. The weight average molecular weights of the resins were from $4.0\times10^4$ to $5.0\times10^4$.

TABLE 4

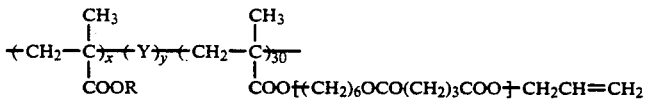

(x/y: weight ratio; x + y = 70

| Synthesis Example | Dispersion-stabilizing Resin | R | —Y— | x/y |
|---|---|---|---|---|
| 29 | P-29 | $-C_{18}H_{37}$ | $-CH_2-C(CH_3)(COO(CH_2)_2OH)-$ | 60/10 |
| 30 | P-30 | $-C_{12}H_{25}$ | $-CH_2-C(CH_3)(COO(CH_2)_2N(CH_3)_2)-$ | 65/5 |
| 31 | P-31 | $-C_{12}H_{25}$ | $-CH_2-C(CH_3)(COOCH_2CF_3)-$ | 55/15 |

TABLE 4-continued

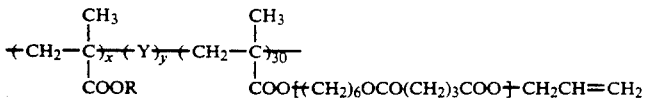

(x/y: weight ratio; x + y = 70

| Synthesis Example | Dispersion-stabilizing Resin | R | —Y— | x/y |
|---|---|---|---|---|
| 32 | P-32 | $-C_{16}H_{33}$ | $-CH_2-CH-$ 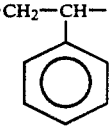 | 60/10 |
| 33 | P-33 | $-C_{12}H_{25}$ | $-CH_2-C(CH_3)(COOC_4H_9)-$ | 50/20 |
| 34 | P-34 | $-C_{20}H_{41}$ | $-CH_2CH(COO(CH_2)_2COO(CH_2)_5OH)-$ | 60/10 |

SYNTHESIS EXAMPLE 35 OF DISPERSION-STABILIZING RESIN: P-35

A mixture of 75 g of octadecyl methacrylate, 25 g of the macromonomer MM-3, and 150 g of toluene was heated to 75° C. under nitrogen gas stream and, after adding 1.0 g of A.I.B.N. to the reaction mixture, the reaction was carried out for 4 hours. Then, after adding 0.5 g of A.I.B.N. to the reaction mixture, the reaction was carried out for 3 hours and, after further adding thereto 0.3 g of A.I.B.N., the reaction was carried out for 2 hours.

After cooling the reaction mixture, 7.4 g of methacrylic anhydride and 1.0 g of t-butylhydroquinone were added thereto at 25° C. followed by stirring for one hour, and the reaction was further carried out at 50° C. After cooling, the reaction mixture was reprecipitated from 2 liters of methanol. The precipitated powdery solid product was collected by filtration and dried under reduced pressure. The percent reaction was determined by measuring the amount of remaining hydroxy groups unreacted in the polymer obtained by a known acetylation method and was found to be 97.8%. The amount of the product (dispersion-stabilizing resin P-35) was 64 g and the weight average molecular weight thereof was $3.8\times10^4$.

Dispersion-stabilizing resin P-35:

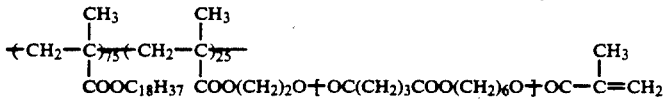

SYNTHESIS EXAMPLE 36 OF DISPERSION-STABILIZING RESIN: P-36

The same polymerization reaction as described in Synthesis Example 35 of P-35 was carried out using a mixture of 75 g of hexadecyl methacrylate, 25 g of a macromonomer MM-7 having the following structure, and 150 g of toluene.

Macromonomer MM-7:

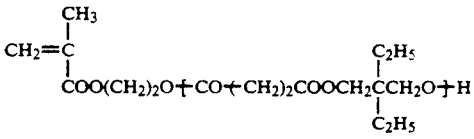

After cooling the resulting reaction mixture to 25° C., 2.5 g of vinyl acetate was added thereto followed by stirring. Then, a mixture of 7.2 g of D.C.C., 0.3 g of 4-(N,N-dimethylamino)pyridine, and 50 g of methylene chloride was added dropwise to the mixture over a period of one hour. The resulting mixture was further mixed for 4 hours. Then, 2 ml of formic acid was added to the mixture and, after stirring for one hour, the precipitated crystals were filtered off. The filtrate obtained was reprecipitated from 2 liters of methanol, and the precipitated powdery crystals were collected by filtration and dissolved in 200 ml of methylene chloride. The solution thus obtained was reprecipitated from one liter of methanol, and the precipitated powdery crystals were collected by filtration and dried under reduced pressure to obtain 58 g of a powdery product (dispersion-stabilizing resin P-36) having a weight average molecular weight of $3.6\times10^4$.

Dispersion-stabilizing resin P-36:

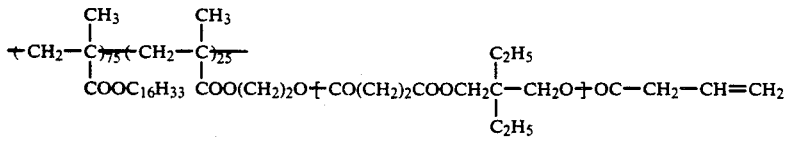

SYNTHESIS EXAMPLE 37 OF DISPERSION-STABILIZING RESIN: P-37

By following the same procedure as described in Synthesis Example 35 of P-35 except that 5.3 g of methacryloyl isocyanate was used in place of 7.4 g of methacrylic anhydride, a dispersion-stabilizing resin P-37 was synthesized.

Dispersion-stabilizing resin P-37:

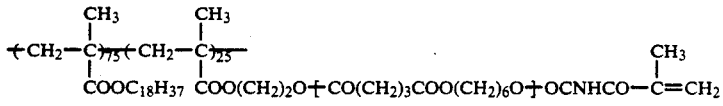

Weight average molecular weight: $4.0\times10^4$

SYNTHESIS EXAMPLES 38 to 45 OF DISPERSION-STABILIZING RESIN: P-38 to P-45

A copolymer was synthesized by the same method as described in Synthesis Example 35 of P-35, and then, each of the dispersion-stabilizing resins shown in Table 5 below was synthesized using each monomer having —COOH and D.C.C. as a condensing agent.

The weight average molecular weights of the resins P-38 to P-45 were from $3\times10^4$ to $5\times10^4$.

TABLE 5

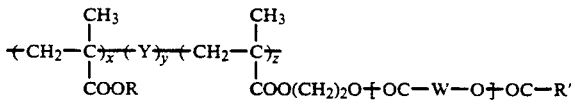

(x/y/z: weight composition ratio)

| Synthesis Example | Dispersion-stabilizing Resin | —R | —Y— | x/y/z | —W— | —R' |
|---|---|---|---|---|---|---|
| 38 | P-38 | $-C_{12}H_{25}$ | $(CH_2)_6$ | 50/20/30 | $(CH_2)_3CO(CH_2)_6$ | $(CH_2)_2CH=CH_2$ |
| 39 | P-39 | $-C_{18}H_{37}$ | $-CH_2-C(CH_3)(COOH)-$ | 80/5/15 | $(CH_2)_{10}CH(C_6H_{13})-$ | $-CH=CH_2$ |
| 40 | P-40 | $-C_{20}H_{41}$ | $-CH_2-C(CH_3)(COOCH_2(CF_2)_2CF_2H)-$ | 60/10/30 | $(CH_2)_{16}$ | 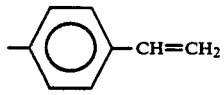 |
| 41 | P-41 | $-C_{18}H_{37}$ | $-CH_2-C(CH_3)(COOC_{10}H_{21})-$ | 60/15/25 | $-C(CH_3)_2-CH_2-$ | $(CH_2)_2NHOC(CH=CH_2)$ |
| 42 | P-42 | $-C_{14}H_{29}$ | — | 60/0/40 | $(CH_2)_3CO-OCH_2C(CH_3)_2-CH_2-$ | $(CH_2)_2COO-CH_2CH=CH_2$ |
| 43 | P-43 | $-C_{12}H_{25}$ | — | 80/0/20 | $(CH_2)_5$ | $-CH=CH(CH_3)$ |
| 44 | P-44 | $-C_{13}H_{27}$ | $-CH_2-CH(CONH_2)-$ | 85/5/10 | $(CH_2)_3COOCH_2C(C_2H_5)_2CH_2-$ | $-C(CH_3)=CH_2$ |

TABLE 5-continued

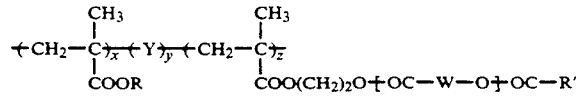

(x/y/z: weight composition ratio)

| Synthesis Example | Dispersion-stabilizing Resin | —R | —Y— | x/y/z | —W— | —R' |
|---|---|---|---|---|---|---|
| 45 | P-45 | $-C_{18}H_{37}$ | — | 80/0/20 | $-CH{=}CH-COOCH_2\overset{C_4H_9}{\overset{\vert}{C}}HCH_2-$ | $\leftarrow CH_2)_{11}NHOC-\overset{CH_3}{\overset{\vert}{C}}{=}CH_2$ |

SYNTHESIS EXAMPLE 46 OF DISPERSION-STABILIZING RESIN: P-46

A mixture of 75 g of dodecyl methacrylate, 25 g of a difunctional macromonomer MD-1 having the following structure, and 300 g of toluene was heated to 65° C. under nitrogen gas stream and, after adding 1.0 g of 2,2'-azobis(valeronitrile) (A.B.V.N.) to the reaction mixture, the reaction was carried out for 4 hours. Then, after adding 0.5 g of A.B.V.N. to the reaction mixture, the reaction was carried out for 2 hours and, after further adding thereto 0.3 g of A.B.V.N., the reaction was carried out for 2 hours. After cooling, the reaction mixture was reprecipitated from 2 liters of methanol, and the viscous product thus formed was collected by decantation and dried under reduced pressure. The amount of the product (dispersion-stabilizing resin P-46) was 73 g, and the weight average molecular weight thereof was $6.7\times10^4$.

Difunctional Macromonomer MD-1:

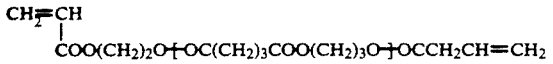

Dispersion-stabilizing resin P-46:

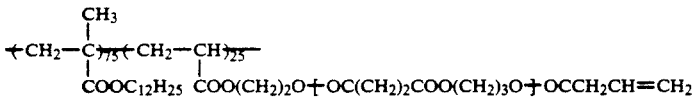

PRODUCTION EXAMPLE 1 OF LATEX GRAINS: D-1

A mixture of 10 g of the resin P-1 produced in Synthesis Example 1 of dispersion-stabilizing resin, 100 g of vinyl acetate, and 380 g of Isopar H was heated to 70° C. with stirring under nitrogen gas stream. Then, after adding 0.8 g of A.B.V.N. to the reaction mixture, the; reaction was carried out for 2 hours and, after further adding thereto 0.6 g of A.B.V.N., the reaction was carried out for 2 hours. Twenty minutes after the addition of the polymerization initiator, the reaction mixture became white turbid, and the reaction temperature raised to 88° C. Then, the mixture was stirred for 2 hours at 100° C. to distil off unreacted vinyl acetate. After cooling, the reaction mixture was passed through a 200 mesh nylon cloth to obtain latex grains having a mean grain size of 0.21 μm with a polymerization ratio of 86% as a white dispersion.

PRODUCTION EXAMPLES 2 to 31 OF LATEX GRAINS D-2 to D-31

By following the same procedure as Production Example 1 of latex grains except that each of the dispersion-stabilizing resins shown in Table 6 below was used in place of 10 g of the dispersion-stabilizing resin P-1, each of latex grains shown in Table 6 was prepared.

TABLE 6

| Synthesis Latex | Latex Grains | Dispersion-stabilizing Resin and Amount thereof | | Mean Grain Size of Latex (μm) |
|---|---|---|---|---|
| 2 | D-2 | P-2 | 10 g | 0.18 |
| 3 | D-3 | P-3 | 10 g | 0.20 |
| 4 | D-4 | P-4 | 12 g | 0.21 |
| 5 | D-5 | P-5 | 10 g | 0.18 |
| 6 | D-6 | P-6 | 8 g | 0.22 |
| 7 | D-7 | P-7 | 12 g | 0.23 |
| 8 | D-8 | P-8 | 14 g | 0.19 |
| 9 | D-9 | P-9 | 10 g | 0.22 |
| 10 | D-10 | P-10 | 12 g | 0.24 |
| 11 | D-11 | P-11 | 13 g | 0.22 |
| 12 | D-12 | P-12 | 10 g | 0.21 |
| 13 | D-13 | P-13 | 13 g | 0.25 |
| 14 | D-14 | P-14 | 12 g | 0.20 |
| 15 | D-15 | P-15 | 9 g | 0.22 |
| 16 | D-16 | P-16 | 14 g | 0.23 |
| 17 | D-17 | P-17 | 9 g | 0.26 |
| 18 | D-18 | P-18 | 13 g | 0.28 |
| 19 | D-19 | P-19 | 14 g | 0.30 |
| 20 | D-20 | P-24 | 8 g | 0.18 |
| 21 | D-21 | P-27 | 14 g | 0.23 |
| 22 | D-22 | P-28 | 15 g | 0.26 |
| 23 | D-23 | P-29 | 12 g | 0.18 |
| 24 | D-24 | P-30 | 10 g | 0.20 |
| 25 | D-25 | P-31 | 12 g | 0.23 |
| 26 | D-26 | P-33 | 8 g | 0.19 |
| 27 | D-27 | P-36 | 12 g | 0.21 |
| 28 | D-28 | P-37 | 14 g | 0.18 |
| 29 | D-29 | P-40 | 12 g | 0.20 |
| 30 | D-30 | P-42 | 12 g | 0.23 |
| 31 | D-31 | P-46 | 12 g | 0.24 |

PRODUCTION EXAMPLE 32 OF LATEX GRAINS: D-32

A mixture of 10 g of the dispersion-stabilizing resin P-43, 100 g of vinyl acetate, 5 g of crotonic acid and 468 g of Isopar E was heated to 70° C. with stirring under nitrogen gas stream and, after adding 1.0 g of A.B.V.N. to the reaction mixture, the reaction was carried out for 6 hours. Then, the reaction mixture was stirred for one hour at 100° C. to distil off the remaining vinyl acetate. After cooling, the reaction mixture was passed through a 200 mesh nylon cloth to obtain the desired latex grains having a mean grain size of 0.23 μm with a polymerization ratio of 85% as a white dispersion.

PRODUCTION EXAMPLE 33 OF LATEX GRAINS: D-33

A mixture of 12 g of the dispersion-stabilizing resin P-28, 100 g of vinyl acetate, 6.0 g of 4-pentenoic acid and 380 g of Isopar G was heated to 75° C. with stirring under nitrogen gas stream. Then, after adding 0.8 g of A.B.V.N. to the reaction mixture, the reaction was carried out for 4 hours and, after further adding thereto 0.5 g of A.B.V.N., the reaction was carried out for 2 hours. After cooling, the reaction mixture was passed through a 200 mesh nylon cloth to obtain latex grains having a mean grain size of 0.25 μm as a white dispersion.

PRODUCTION EXAMPLE 34 OF LATEX GRAINS: D-34

A mixture of 14 g of the dispersion-stabilizing resin P-24, 85 g of vinyl acetate, 15 g of N-vinylpyrrolidone and 380 g of n-decane was heated to 75° C. with stirring under nitrogen gas stream. Then, after adding 1.7 g of A.B.V.N. to the reaction mixture, the reaction was carried out for 4 hours and, after further adding thereto 0.5 g A.B.V.N., the reaction was carried out for 2 hours. After cooling, the reaction mixture was passed through a 200 mesh nylon cloth to obtain the desired latex grains having mean grain size of 0.25 μm as a white dispersion.

PRODUCTION EXAMPLE 36 OF LATEX GRAINS: D-36

A mixture of 20 g of the dispersion-stabilizing resin P-40, 100 g of styrene and 380 g of Isopar H was heated to 50° C. with stirring under nitrogen gas stream. After adding a hexane solution of n-butyl lithium to the mixture in an amount of 1.0 g as a solid content of n-butyl lithium, and the reaction was carried out for 4 hours. After cooling, the reaction mixture was passed through a 200 mesh nylon cloth to obtain latex grains having mean grain size of 0.30 μm as a white dispersion.

PRODUCTION EXAMPLE 37 OF LATEX GRAINS: COMPARISON EXAMPLE A-1

The same procedure as Production Example 1 of latex grains was followed using a mixture of 10 g of a dispersion-stabilizing resin R-1 which is described in JP-A-61-43757 having the structure shown below, 100 g of vinyl acetate, and 390 g of Isopar H. The mean grain size of a white dispersion thus obtained was 0.20 μm and the polymerization ratio was 85%.

Dispersion-stabilizing resin R-1: (for comparison)

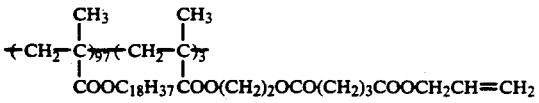

Weight average molecular weight: $6.5\times10^4$ (Composition ratio was by weight)

PRODUCTION EXAMPLE 38 OF LATEX GRAINS: (COMPARISON EXAMPLE B-1)

The same procedure as Production Example 1 of latex grains was followed using a mixture of 18 g of poly(octadecyl methacrylate), 100 g of vinyl acetate, 1.0 g of octadecyl methacrylate, and 385 g of Isopar H.

Thus, latex grains having a mean grain size of 0.22 μm with a polymerization ratio of 85% were obtained as a white dispersion. (Corresponding to the latex grains described in JP-A-60-179751).

PRODUCTION EXAMPLE 39 OF LATEX GRAINS: D-39

A mixture of 12 g of the dispersion-stabilizing resin P-1, 100 g of vinyl acetate, 1.0 g of octadecyl methacrylate and 384 g of Isopar H was heated to 70° C. with stirring under nitrogen gas stream and, after adding 0.8 g of 2,2'-azobis(isovaleronitrile) (A.I.V.N.) to the reaction mixture, the reaction was carried out for 6 hours. Twenty minutes after the addition of the polymerization initiator, the reaction mixture became white turbid and the reaction temperature raised to 88° C. Then, the mixture was stirred for 2 hours at 100° C. to distill off unreacted vinyl acetate. After cooling, the reaction mixture was passed through a 200 mesh nylon cloth to obtain latex grains having a mean grain size of 0.24 μm with a polymerization ratio of 90%.

PRODUCTION EXAMPLE 40 to 50 OF LATEX GRAINS: D-40 to D-50

By following the same procedure as Production Example 39 of latex grains except that each of the dispersion-stabilizing resins described in Table 7 below was used in place of the dispersion-stabilizing grain P-1, each of latex grains D-40 to D-50 was prepared.

TABLE 7

| Production Example of Latex Grains | Latex Grains | Dispersion-Stabilizing Resin | Latex Grains: Polymerization Ratio (%) | Latex Grains: Mean Grain Size (μm) |
|---|---|---|---|---|
| 40 | D-40 | P-2 | 88 | 0.25 |
| 41 | D-41 | P-3 | 89 | 0.24 |
| 42 | D-42 | P-4 | 87 | 0.26 |
| 43 | D-43 | P-5 | 90 | 0.24 |
| 44 | D-44 | P-6 | 85 | 0.23 |
| 45 | D-45 | P-7 | 86 | 0.25 |
| 46 | D-46 | P-8 | 85 | 0.23 |
| 47 | D-47 | P-9 | 88 | 0.24 |
| 48 | D-48 | P-12 | 83 | 0.22 |
| 49 | D-49 | P-15 | 86 | 0.28 |
| 50 | D-50 | P-24 | 86 | 0.22 |

PRODUCTION EXAMPLE 51 to 56 OF LATEX GRAINS: D-51 to D-56

By following the same procedure as Production Example 39 of latex grains except that 1 g of each of the monomers described in Table 9 below was used in place of 1 g of octadecyl methacrylate, each of latex grains 51 to 56 was prepared.

TABLE 8

| Production Example of Latex Grains | Latex Grains | Monomer | Latex Grains: Polymerization Ratio (%) | Latex Grains: Mean Grain Size (μm) |
|---|---|---|---|---|
| 51 | D-51 | Docosanyl Methacrylate | 87 | 0.23 |
| 52 | D-52 | Hexadecyl Methacrylate | 87 | 0.24 |
| 53 | D-53 | Tetradecyl Methacrylate | 88 | 0.24 |
| 54 | D-54 | Tridecyl Methacrylate | 86 | 0.24 |
| 55 | D-55 | Dodecyl Methacrylate | 86 | 0.23 |
| 56 | D-56 | Decyl Methacrylate | 87 | 0.26 |

PRODUCTION EXAMPLE 57 OF LATEX GRAINS: D-57

A mixture of 6 g of the dispersion-stabilizing resin P-10, 8 g of poly(octadecyl methacrylate), 100 g of vinyl acetate, 0.8 g of dodecyl metharcrylate, and 400 g of Isopar H was heated to 75° C. with stirring under nitrogen gas stream. Then, after adding 0.7 g of 2,2'-azobis(isobutyronitrile) (A.I.B.N.) to the reaction mixture, the reaction was carried out for 4 hours and, after further adding thereto 0.5 g of A.I.B.N., the reaction was carried out for 2 hours. After cooling, the reaction mixture was passed through a 200 mesh nylon cloth to obtain latex grains having a mean grain size of 0.20 μm as a white dispersion.

PRODUCTION EXAMPLE 58 OF LATEX GRAINS: D-58

A mixture of 14 g of the dispersion-stabilizing resin P-30, 90 g of vinyl acetate, 10 g of N-vinylpyrrolidone, 1.5 g of octadecyl methacrylate, and 400 g of isododecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain latex grains having a mean grain size of 0.25 μm as a white dispersion.

PRODUCTION EXAMPLE 59 OF LATEX GRAINS: D-59

A mixture of 16 g of the dispersion-stabilizing resin P-1, 94 g of vinyl acetate, 6 g of crontonic acid, 2 g of hexadecyl methacrylate, and 382 g of Isopar G was heated to 60° C. with stirring under nitrogen gas stream. Then, after adding 1.0 g of A.I.V.N. to the reaction mixture, the reaction was carried out for 2 hours and, after further adding thereto 0.5 g of A.I.V.N., the reaction was carried out for 2 hours. After cooling, the reaction mixture was passed through a 200 mesh nylon cloth to obtain latex grains having a mean grain size of 0.24 μm as a white dispersion.

PRODUCTION EXAMPLE 60 OF LATEX GRAINS: D-60

A mixture of 25 g of the dispersion-stabilizing resin P-16, 100 g of methyl methacrylate, 2 g of decyl methacrylate, 0.8 g of n-dodecylmercaptan, and 539 g of Isopar H was heated to 60° C. with stirring under nitrogen gas stream and, after adding 0.7 g of A.I.V.N. to the reaction mixture, the reaction was carried out for 4 hours. After cooling, the reaction mixture was passed through a 200 mesh nylon cloth to obtain latex grains having a mean grain size of 0.25 μm as a white dispersion.

PRODUCTION EXAMPLE 61 OF LATEX GRAINS: D-61

A mixture of 20 g of the dispersion-stabilizing resin P-19, 100 g of methyl methacrylate, 2 g of octadecyl vinyl ether, and 380 g of Isopar H was heated to 45° C. with stirring under nitrogen gas stream. Then, after adding a hexane solution of n-butyl lithium to the reaction mixture in an amount of 1.0 g as a solid content of n-butyl lithium, the reaction was carried out for 4 hours. After cooling, the reaction mixture was passed through a 200 mesh nylon cloth to obtain latex grains having a mean grain size of 0.27 μm as a white dispersion.

PRODUCTION EXAMPLE 62 OF LATEX GRAINS: (COMPARISON EXAMPLE A-2)

By following the same procedure as Production Example 39 of latex grain except that a mixture of 20 g of poly(octadecyl methacrylate) (Dispersion-stabilizing Resin R-1), 100 g of vinyl acetate, 1 g of octadecyl methacrylate, and 380 g of Isopar H, latex grains having a mean grain size of 0.27 μm with a polymerization ratio of 88% were obtained as a white dispersion. (Corresponding to the latex grains described in JP-A-60-17951).

PRODUCTION EXAMPLE 63 OF LATEX GRAINS: (COMPARISON EXAMPLE B-2)

A mixture of 97 g of octadecyl methacrylate, 3 g of acrylic acetate, 200 g of toluene was heated to 75° C. with stirring under nitrogen gas stream and, after adding 1.0 g of A.I.B.N. to the reaction mixture, the reaction was carried out for 40 hours. Then, after adding thereto 12 g of glycidyl metacrylate, 1.0 g of t-butylhydroquinone, and 1.2 g of N,N-dimethyldodecylamine, the mixture was stirred for 40 hours at 100° C. After cooling, the reaction mixture was reprecipitated from 2 liters of methanol, and the white powder was collected by filtration and dried to obtain a dispersion-stabilizing resin R-2 having the structure shown below. The amount of the product was 84 g and the weight average molecular weight thereof was 35,000.

Dispersion-stabilizing resin P-2:

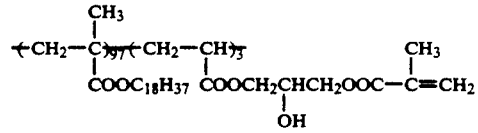

(weight composition ratio)

By following the same procedure as Production Example 39 except that a mixture of 10 g of the above-obtained dispersion-stabilizing resin R-2, 100 g of vinyl acetate, 1.0 g of octadecyl methacrylate, and 384 g of Isopar H was used, latex grains having a mean grain size of 0.15 μm with a polymerization ratio of 89% were obtained as a white dispersion. (Corresponding to the latex grains described in JP-A-61-63855).

PRODUCTION EXAMPLE 64 OF LATEX GRAINS: (COMPARISON EXAMPLE C-2)

By following the same procedure as Production Example 39 of latex grains except that a mixture of 12 g of a dispersion-stabilizing resin R-3 having the structure shown below, 100 g of vinyl acetate, 1.0 g of octadecyl methacrylate, and 382 g of Isopar H was used, latex grains having a mean grain size of 0.23 μm with a polymerization ratio of 87% were obtained as a white dispersion. (Corresponding to the latex grains described in JP-A-60-185963).

Dispersion-stabilizing resin P-3:

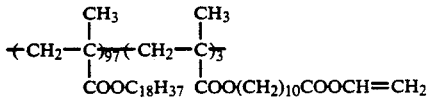

(weight composition ratio)

Weight average molecular weight: 46,000

PRODUCTION EXAMPLE 65 OF LATEX GRAINS: D-65

A mixture of 12 g of dispersion-stabilizing resin P-1, 100 g of vinyl acetate, 1.5 g of Compound II-2-19 as the monomer B-2, and 384 g of Isopar H was heated to 70° C. with stirring under nitrogen gas stream. Then, after adding 0.8 g of A.I.V.N. to the reaction mixture, the reaction was carried out for 6 hours. Twenty minutes after the addition of the polymerization initiator, the mixture became white tubid and the reaction temperature raised to 88° C. Then, the reaction mixture was stirred for 2 hours at 100° C. to distil off unreacted vinyl acetate. After cooling, the reaction mixture was passed through a 200 mesh nylon cloth to obtain latex grains having a mean grain size of 0.20 μm with a polymerization ratio of 86 as a white dispersion.

PRODUCTION EXAMPLE 66 to 86 OF LATEX GRAINS: D-66 to D-86

By following the same procedure as Production Example 65 of latex grains except that each of the dispersion-stabilizing resins and each of the monomers B-2 shown in Table 9 below were used in place of the dispersion-stabilizing resin P-1 and Compound II-2-19 as the monomer B-2, each of latex grains D-66 to D-86 was prepared. The polymerization ratios of the products were from 85% to 90%.

TABLE 9

| Production Example of Latex Grains | Latex Grains | Dispersion-Stabilizing Resin | Monomer (B-2) | Mean Grain Size of Latex (μm) |
|---|---|---|---|---|
| 66 | D-66 | P-1 | II-2-1 | 0.19 |
| 67 | D-67 | P-1 | II-2-2 | 0.19 |
| 68 | D-68 | P-1 | II-2-3 | 0.20 |
| 69 | D-69 | P-1 | II-2-8 | 0.22 |
| 70 | D-70 | P-1 | II-2-9 | 0.22 |
| 71 | D-71 | P-1 | II-2-10 | 0.20 |
| 72 | D-72 | P-1 | II-2-11 | 0.18 |
| 73 | D-73 | P-1 | II-2-14 | 0.17 |
| 74 | D-74 | P-1 | II-2-18 | 0.21 |
| 75 | D-75 | P-2 | II-2-10 | 0.19 |
| 76 | D-76 | P-3 | II-2-19 | 0.20 |
| 77 | D-77 | P-4 | II-2-20 | 0.22 |

TABLE 9-continued

| Production Example of Latex Grains | Latex Grains | Dispersion-Stabilizing Resin | Monomer (B-2) | Mean Grain Size of Latex (μm) |
|---|---|---|---|---|
| 78 | D-78 | P-5 | II-2-21 | 0.22 |
| 79 | D-79 | P-10 | II-2-22 | 0.23 |
| 80 | D-80 | P-12 | II-2-23 | 0.23 |
| 81 | D-81 | P-15 | II-2-24 | 0.22 |
| 82 | D-82 | P-16 | II-2-15 | 0.23 |
| 83 | D-83 | P-17 | II-2-16 | 0.18 |
| 84 | D-84 | P-23 | II-2-26 | 0.19 |
| 85 | D-85 | P-24 | II-2-27 | 0.20 |
| 86 | D-86 | P-26 | II-2-29 | 0.21 |

PRODUCTION EXAMPLE 87 OF LATEX GRAINS: D-87

A mixture of 4 g (as a solid component) of the dispersion-stabilizing resin P-25, 7 g of poly(dodecyl metacrylate), 100 g of vinyl acetate, 1.5 g of Compound II-2-15 as the monomer B-2, and 380 g of n-decane was heated to 75° C. with stirring under nitrogen gas stream. After adding 1.0 g of A.I.B.N. to the reaction mixture, the reaction was carried out for 4 hours and, after further adding thereto 0.5 g of A.I.B.N., the reaction was carried out for 2 hours. The reaction mixture was stirred for 2 hours at 110° C. to distil off the low-boiling solvent and the remaining vinyl acetate. After cooling, the reaction mixture was passed through a 200 mesh nylon cloth to obtain latex grains having a mean grain size of 0.16 μm as a white dispersion.

PRODUCTION EXAMPLE 88 OF LATEX GRAINS: D-88

A mixture of 12 g of dispersion-stabilizing resin P-30, 85 g of vinyl acetate, 2.0 g of Compound II-2-23 as the monomer B-2, 15 g of N-vinylpyrrolidone, and 400 g of dodecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain latex grains having a mean grain size of 0.22 μm as a white dispersion.

PRODUCTION EXAMPLE 89 OF LATEX GRAINS: D-89

A mixture of 14 g of dispersion-stabilizing resin P-29, 100 g of vinyl acetate, 1.5 g of Compound II-2-18 as the monomer B-2, 5 g of 4-pentenoic acid, and 383 g of Isopar G was heated to 60° C. with stirring under nitrogen gas stream. After adding 1.0 g of A.I.V.N. to the reaction mixture, the reaction was carried out for 2 hours. After cooling, the reaction mixture was passed through a 200 mesh nylon cloth to obtain latex grains having a mean grain size of 0.22 μm as a white dispersion.

PRODUCTION EXAMPLE 88 OF LATEX GRAINS: D-90

A mixture of 18 g of dispersion-stabilizing resin P-16, 2 g of Compound II-2-16 as the monomer B-2, 1 g of n-dodecylmercaptan, 100 g of methyl methacrylate, and 478 g of Isopar H was heated to 65° C. with stirring under nitrogen gas stream and, after adding 1.2 g of A.I.V.N. to the reaction mixture, the reaction was carried out for 4 hours. After cooling, the reaction mixture was passed through a 200 mesh nylon cloth to remove coarse grains and to obtain latex grains having a mean grain size of 0.28 μm as a white dispersion.

PRODUCTION EXAMPLE 91 OF LATEX GRAINS: D-91

A mixture of 20 g of dispersion-stabilizing resin P-19, 100 g of styrene, 4 g of Compound II-2-25 as the monomer B-2, and 380 g of Isopar H was heated to 50° C. with stirring under nitrogen gas stream and, after adding a hexane solution of n-butyl lithium to the reaction mixture in an amount of 1.0 g as a solid component of n-butyl lithium, the reaction was carried out for 4 hours. After cooling, the reaction mixture was passed through a 200 mesh nylon cloth to obtain latex grains having a mean grain size of 0.24 μm as a white dispersion.

PRODUCTION EXAMPLE 92 OF LATEX GRAINS: (COMPARISON EXAMPLE A-3)

By following the same procedure as Production Example 65 except that a mixture of 20 g of poly(octadecyl methacrylate) having a mean average molecular weight of 35,000, 100 g of vinyl acetate, 1.5 g of Compound II-2-19 of the monomer B-2, and 380 g of Isopar H was used, latex grains having a mean grain size of 0.23 μm with a polymerization ratio of 88% were obtained as a white dispersion. (Corresponding to the latex grains described in JP-A-62-151868).

PRODUCTION EXAMPLE 93 OF LATEX GRAINS: (COMPARISON EXAMPLE B-3)

By following the same procedure as Production Example 65 except that a mixture of 14 g of a dispersion-stabilizing resin having the structure shown below, 100 g of vinyl acetate, 1.5 g of Compound II-2-19 as the monomer B-2, and 386 g of Isopar H was used, latex grains having a mean grain size of 0.25 μm with a polymerization ratio of 90% were obtained as a white dispersion. (Corresponding to the latex grains described in JP-A-63-66567).

Dispersion-Stabilizing Resin:

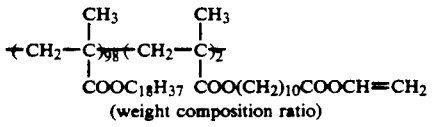

Weight average molecular weight: 43,000

EXAMPLE 1

In a paint shaker (manufactured by Tokyo Seiki K.K.) were placed 10 g of a dodecyl methacrylate/acrylic acid copolymer (copolymerization ratio: 95/5 by weight), 10 g of nigrosine, and 30 g of Shellsol 71 together with glass beads followed by dispersing to prepare a fine dispersion of nigrosine.

Then, a liquid developer for electrostatic photography was prepared by diluting 30 g of the resin dispersion obtained in Production Example 1 of latex grains, 2.5 g of the aforesaid nigrosine dispersion, 15 g of a higher alcohol, FOC-1600 (hexadecyl alcohol, trade name, made by Nissan Chemical Industries, Ltd.), and 0.08 g of a copolymer of octadecene and semi-maleic octadecylamide with one liter of Shellsol 71.

Comparison Liquid Developers A-1 and B-1

Two kinds of comparison liquid developers A-1 and B-1 were prepared in the same manner as above using the resin grains (latex grains) shown below in place of the aforesaid latex grains.

Comparison Liquid Developer A-1

The resin dispersion obtained in Production Example 37 of latex grains was used.

Comparison Liquid Developer B-1

The resin dispersion obtained in Production Example 37 of latex grains was used.

Comparison Liquid Developer B-1

The resin dispersion obtained in Production Example 38 of latex grain was used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 4 plates/minutes. Furthermore, after processing 2,000 plates of ELP Master II Type, the occurrence of stains of the developing apparatus by adhesion of the toner was observed. The blackened ratio (imaged area) of the duplicated images was determined using 20% original.

The results obtained are shown in Table 10 below.

TABLE 10

| Test No. | Developer | Stains of Developing Apparatus | Images of the 200th Plate | Printing Durability (No. of Prints) |
|---|---|---|---|---|
| 1 | Developer of Invention | No toner residue attached | Clear | 10,000 or more |
| 2 | Comparison Developer A-1 | Toner residue adhered | Letter parts lost, density of solid black portion lowered, background area fogged. | 10,000 or more |
| 3 | Comparison Developer B-1 | Toner residue adhered slightly | Density of five slightly lowered. Dmax lowered. | 6000 |

As is clear from the above results, when printing plates were produced by the aforesaid processing conditions using each of the liquid developers, only the liquid developer according to the present invention caused no stains of the developing apparatus and provided clear images of the 2,000th plate.

Then, the offset printing master plate (ELP Master) prepared by processing using each of the liquid developers was used in a conventional manner, and the number of prints obtained before occurrence of defects of letters on the images of prints, lowering of the density of the solid black portions of the images, etc., was checked. The results showed that each of the liquid developer of this invention and the comparison liquid developer A-1 provided more than 10,000 prints without accompanied by the aforesaid failures, while the master plate prepared using the comparison developer B-1 resulted in the failures after 8,000 prints.

As is clear from the aforesaid results, only the liquid developer according to the present invention showed no stains of the developing apparatus and provided greatly increased number of prints by the master plates.

That is, in the case of using the comparison developer A-1, there was no problem on the number of prints, but the developing apparatus was too stained to further use subsequently.

Also, in the case of the comparison example B-1, the developing apparatus was stained (in particular, back electrode), when the developer was used under the aforesaid severe conditions (ordinary, processing speed was 2 or 3 plates/minutes and the blackened ratio was about 8 to 10%), and, after the formation of about 2,000 plates, the images quality of the duplicated images on the plate was reduced (reduction of Dmax, blurring of fine lines, etc.). The number of prints by master plate was greatly reduced in the case of the comparison liquid B-1.

These results show that the resin grains of this invention are clearly excellent.

EXAMPLE 2

A mixture of 100 g of the white dispersion obtained in Production Example 2 of latex grains and 1.5 g of Sumikalon Black was stirred for 4 hours at 100° C. After cooling to room temperature, the reaction mixture was passed through a 200 mesh nylon cloth to remove the remaining dye whereby a black resin dispersion having a mean grain size of 0.20 μm was obtained.

Then, a liquid developer was prepared by diluting 32 g of the aforesaid black resin dispersion, 0.05 g of zirconium naphthenate, and 15 g of a higher alcohol, FOC-1800 (octadecyl alcohol, trade name, made by Nissan Chemical Industries, Ltd.) with one liter of Shellsol 71.

When the liquid developer was applied to the same developing apparatus as in Example 1, no occurrence of stains of the developing apparatus by adhesion of the toner was observed even after developing 2,000 plates.

Also, the image quality of the offset printing master plate obtained was clear and the image quality of the 10,000th print was very clear.

EXAMPLE 3

A mixture of 100 g of the white dispersion obtained in Production Example 33of latex grains and 3 g of Victoria Blue B was heated to a temperature of from 70° C. to 80° C. for 6 hours. After cooling to room temperature, the reaction mixture was passed through a 200 mesh nylon cloth to remove the remaining dye whereby a blue resin dispersion having a mean grain size of 0.16 μm was obtained.

Then, a liquid developer was prepared by diluting 32 g of the aforesaid blue resin dispersion and 0.05 g of zirconium naphthenate with one liter of Isopar H.

When the liquid developer was applied to the same developing apparatus as in Example 1, no occurrence of stains of the developing apparatus by adhesion of the toner was observed even after developing 2,000 plates. Also, the image quality of the offset printing master plate obtained was clear and the image quality of the 10,000th print obtained using the printing plate was very clear.

EXAMPLE 4

A liquid developer was prepared by diluting 32 g of the white resin dispersion obtained in Production Example 20 of latex grains, 2.5 g of the nigrosine dispersion obtained in Example 1, 15 g of FOC-1400 (trade name of tetradecyl alcohol, made by Nissan Chemical Industries, Ltd.), and 0.02 g of a semi-docosanylamidated product of a copolymer of diisobutylene and maleic anhydride with one liter of Isopar G.

When the liquid developer was applied to the same developing apparatus as in Example 1, no occurrence of stains of the developing apparatus by adhesion of the toner was observed even after developing 2,000 plates. Also, the image quality of the offset printing master plate obtained and the image quality of the 10,000th print obtained using the master plate were very clear.

Furthermore, when the same processing as above was applied after allowing to stand the liquid developer for 3 months, the results were the same as above.

EXAMPLE 5

In a paint shaker were placed 10 g of poly(decylmethacrylate), 30 g of Isopar H, and 8 g of Alkali Blue together with glass beads followed by dispersing for 2 hours to prepare a fine dispersion of Alkali Blue.

Then, a liquid developer was prepared by diluting 30 g of the white resin dispersion obtained in Production Example 3 of latex grains, 4.2 g of the aforesaid Alkali Blue dispersion, and 0.06 g of a semi-docosanylamidated product of the copolymer of diisobutylene and maleic anhydride with one liter of Isopar G.

When the liquid developer was applied to the same developing apparatus as in Example 1, no occurrence of stains of the developing apparatus by adhesion of the toner was observed. Also, the image quality of the offset printing plate obtained and the image quality of the 10,000th print obtained using the master plate were very clear.

EXAMPLES 6 to 31

By following the same procedure as Example 5 except that each of the latexes shown in Table 11 below was used in place of the white resin dispersion D-3, each of liquid developers was prepared.

TABLE 11

| Example | Latex Grains |
|---|---|
| 6 | D-4 |
| 7 | D-5 |
| 8 | D-6 |
| 9 | D-7 |
| 10 | D-8 |
| 11 | D-9 |
| 12 | D-10 |
| 13 | D-11 |
| 14 | D-12 |
| 15 | D-13 |
| 16 | D-14 |
| 17 | D-15 |
| 18 | D-16 |
| 19 | D-17 |
| 20 | D-18 |
| 21 | D-19 |
| 22 | D-21 |
| 23 | D-22 |
| 24 | D-23 |
| 25 | D-24 |
| 26 | D-25 |
| 27 | D-27 |
| 28 | D-28 |
| 29 | D-29 |

TABLE 11-continued

| Example | Latex Grains |
|---|---|
| 30 | D-30 |
| 31 | D-31 |

When each of the liquid developers was applied to the same developing apparatus as in Example 1, no occurrence of stains of the developing apparatus by adhesion of the toner was observed even after developing 2,000 plates. Also, the image quality of the offset printing master plates obtained and the image quality of the 10,000th print obtained using each of the master plates were very clear.

Furthermore, when the same processing as above was applied after allowing to stand each liquid developer for 3 months, the results were the same as above.

EXAMPLE 32

In a paint shaker (manufactured by Tokyo Seiki K.K.) were placed 10 g of a dodecyl methacrylate/acrylic acid copolymer (95/5 by weight ration), 10 g of nigrosine and 30 g of Isopar G together with glass beads followed by dispersing for 4 hours to prepare a fine dispersion of nigroine.

A liquid developer was prepared by diluting 30 g of the white resin dispersion obtained in Production Example 39 of latex grains, 2.5 g of the aforesaid nigrosine dispersion, 0.07 g of a copolymer of octadecene and semi-maleic octadecylamide, and 15 g of a higher alcohol, FOC-1600 (trade name, made by Nissan Chemical Industries, Ltd.) with one liter of Isopar G.

COMPARISON LIQUID DEVELOPERS A-2, B-2, and C-2

Three kinds of liquid developers A-2, B-2, and C-2 were prepared using the following resin dispersions in the aforesaid production method.

COMPARISON LIQUID DEVELOPER A-2

The resin dispersion obtained in Production Example 62 of latex grains was used.

COMPARISON LIQUID DEVELOPER B-2

The resin dispersion obtained in Production Example 63 of latex grains was used.

COMPARISON LIQUID DEVELOPER C-2

The resin dispersion obtained in Production Example 64 of latex grains was used.

An electrographic light-sensitive material, ELP Master II Type (trade name, made by Fuji Photo Film Co., Ltd.) was image exposed and developed by a full-automatic processor, ELP 404V (trade name, made by Fuji Photo Film Co., LOtd.) using each of the liquid developers. The processing speed (plate making speed) was 7 plates/minute. Furthermore, the occurrence of stains of the developing apparatus by adhesion of the toner after processing 3,000 ELP Master II Type plates was checked. The blackened ratio (imaged area) of the duplicated image was determined using 30% original.

The results obtained are shown in Table 12 below.

TABLE 12

| Test No. | Developer | Stains of Developing Apparatus | Images of the 3,000th Plate |
|---|---|---|---|
| 1 | Developer of Invention | No stains | Clear |
| 2 | Comparison Developer A-2 | Toner residue formed greatly | Letter parts lost, solid portion blurred, background fogged |
| 3 | Comparison Developer B-2 | Toner residue formed slightly | Density of solid black portions in image portion lowered, a partial blurring occurred in solid black portions |
| 4 | Comparison Developer C-2 | Toner residue formed slightly | Clear |

As is clear from the above results, when each of the liquid developers was used for making printing plates under the aforesaid severe plate-making condition of very fast plate-making speed, only the liquid developer according to the present invention could provide the 3,000th plate having clear images without staining the developing apparatus.

Then, the offset printing master plate (ELP Master) prepared by processing using each of the liquid developers was used for printing in a conventional manner, and the number of prints obtained before occurrences of defects of the letters on the images of the print, the lowering of the density of the solid black portions of the images, etc., were checked. The results showed that the master plate obtained using each of the liquid developer of this invention and the comparison liquid developers A-2, B-2, and C-2 provided more than 10,000 prints without accompanied by the aforesaid failure.

As described above, only the liquid developer of this invention could advantageously be used for preparing a large number of printing master plates without staining the developing apparatus.

That is, in the cases of using the comparison liquid developers A-2, B-2, and C-2, there was no problem on the number of prints but the developing apparatus was too stained to further use subsequently.

Also, in the case of using the comparison liquid developers B-2 and C-2, staining of the developing apparatus was greatly reduced as compared to the case of using the comparison liquid developer A-2 but the improvement was not satisfactory when the developing condition becomes severe.

That is, the known dispersion-stabilizing resin R-2 used for the comparison liquid developer B-2 has a feature that the resin is a random copolymer containing the monomer (A) (vinyl acetate in the examples) and a component having a polymerizable double bond group copolymerizing with the monomer (A), wherein the polymerizable double bond group exists in a portion near the polymer main chain, whereby the resin is considered to be inferior in the redispersibility of latex grains as compared with the dispersion-stabilizing resin of this invention.

Also, the known dispersion-stabilizing resin R-3 used for the composition liquid developer C-2 has a chemical structure characterized in that the total number of the atoms in the linkage group between the polymerizable double bond group in the resin which is copolymerized with the monomer (A) and the main chain of the polymer is at least 9 and, further, in comparison with the polymerizable double bond group of the formula $$CH_2{=}\overset{\overset{\displaystyle CH_3}{|}}{C}{-}COO{-}$$

in the comparison liquid developer B-2, the structure of the polymerizable double bond group in the comparison liquid developer C-2 is $CH_2{=}CH{-}OCO{-}$ and has preferably good reactivity with vinyl acetate (monomer (A)). Thus, in the case of the comparison liquid developer C-2, the images of the 3,000th printing plates was clear and was greatly improved as compared with the case of using the comparison liquid developer B-2. However, in the case of using the comparison liquid developer C-2, the developing apparatus is yet stained by adhesion of the toner when the developing condition becomes severe.

EXAMPLE 33

A mixture of 100 g of the white resin dispersion obtained in Production Example 39 of latex grains and 1.5 g of Sumikalon Black was stirred for 4 hours at 100° C. After cooling to room temperature, the reaction mixture was passed through a 200 mesh nylon cloth to remove the remaining dye, whereby a black resin dispersion having a mean grain size of 0.25 μm was obtained.

Then, a liquid developer was prepared by diluting 30 g of the aforesaid black resin dispersion, 0.05 g of zirconium naphthenate, and 20 g of FOC-1600 (trade name, made by Nissan Chemical Industries, Ltd.) with one liter of Shellsol 71.

When the liquid developer was applied to the same developing apparatus as used in Example 32, no occurrence of stains of the developing apparatus by adhesion of the toner was observed even after developing 3,000 plates.

Also, the image quality of the offset printing master plate obtained was clear and the image quality of the 10,000th print was very clear.

EXAMPLE 34

A mixture of 100 g of the white resin dispersion obtained in Production Example 59 of latex grains and 3 g of Victoria Blue B was stirred for 6 hours at temperature of from 70° C. to 80° C. After cooling to room temperature, the reaction mixture was passed through a 200 mesh nylon cloth to remove the remaining dye, whereby a blue resin dispersion having a mean grain size of 0.25 μm was obtained.

Then, a liquid developer was prepared by diluting 32 g of the aforesaid blue resin dispersion, 0.05 g of zirconium naphthenate, and 15 g of a higher alcohol, 20 g of FOC-1400 (trade name, made by Nissan Chemical Industries, Ltd.) with one liter of Isopar H.

When the liquid developer was applied to the same developing apparatus as used in Example 32, no occurrence of stains of the developing apparatus by adhesion of the toner was observed even after developing 3,000 plates. Also, the image quality of the offset printing master plate obtained was clear and the image quality of the 10,000th print was very clear.

Furthermore, when after allowing to stand the liquid developer for 3 months, the same processing as above was performed using the resulting liquid developer, the results were the same as those obtained with the developer before storage.

EXAMPLE 35

In a paint shaker were placed 10 g of poly(decyl methacrylate), 30 g of Isopar H, and 8 g of Alkali Blue together with glass beads followed by dispersing for 2 hours to prepare a fine dispersion of Alkali Blue.

Then, a liquid developer was prepared by diluting 30 g of the white resin dispersion obtained in Production Example 39 of latex grains, 4.2 g of the aforesaid Alkali Blue dispersion, 15 g of a higher alcohol, FOC-1400 (trade name, made by Nissan Chemical Industries, Ltd.), and 0.06 g of a semidocosanylamidated product of a copolymer of isobutylene and maleic anhydride with one liter of Isopar G.

When the liquid developer was applied to the same developing apparatus as used in Example 32, no occurrence of stains of the developing apparatus by adhesion of the toner was observed even after developing 3,000 plates. Also, the image quality of the offset printing master plate obtained and the image quality of the 10,000th print were very clear.

EXAMPLES 36 TO 52

Each of liquid developers was prepared by following the same procedure as Example 35 except that 6.0 g (as a solid content) of each of the latex grains shown in Table 13 below was used in plate of the white resin dispersion obtained in Production Example 39 of latex grains.

TABLE 13

| Example No. | Latex Grains | Stains of Developing Apparatus | Image of the 3,000th |
|---|---|---|---|
| 36 | D-39 | No stain | Clear |
| 37 | D-40 | No stain | Clear |
| 38 | D-41 | No stain | Clear |
| 39 | D-42 | No stain | Clear |
| 40 | D-43 | No stain | Clear |
| 41 | D-44 | No stain | Clear |
| 42 | D-45 | No stain | Clear |
| 43 | D-46 | No stain | Clear |
| 44 | D-47 | No stain | Clear |
| 45 | D-48 | No stain | Clear |
| 46 | D-49 | No stain | Clear |
| 47 | D-50 | No stain | Clear |
| 48 | D-51 | No stain | Clear |
| 49 | D-52 | No stain | Clear |
| 50 | D-53 | No stain | Clear |
| 51 | D-54 | No stain | Clear |
| 52 | D-55 | No stain | Clear |

When each of the liquid developers was applied to the same developing apparatus as that used in Example 32, no occurrence of stains of the developing apparatus was observed even after developing 3,000 plates. Also, the image quality of the offset printing master plate and the image quality of the 10,000th print were very clear.

EXAMPLE 53

In a paint shaker were placed 10 g of dodecyl methacrylate/acrylic acid copolymer (95/5 by weight ratio), 10 g of nigrosine and 30 g of Isopar G together with glass beads followed by dispersing to prepare a fine dispersion of nigrosine.

Then, a liquid developer was prepared by diluting 30 g of the resin dispersion obtained in Production Example 65 of latex grains, 2.5 g of the aforesaid nigrosine dispersion, 0.07 g of a copolymer of octadecene and semi-maleic octadecylamide, and 15 g of a higher alcohol, FOC-1600 (trade name, made by Nissan Chemical Industries, Ltd.), with one liter of Isopar G.

COMPARISON LIQUID DEVELOPERS A-3 and B-3

Two kinds of comparison liquid developers A-3 and B-3 were prepared in the same manner as described above using the following resin dispersions in place of the aforesaid resin dispersion.

COMPARISON LIQUID DEVELOPER A-3

The resin dispersion obtained in Production Example 92 of latex grains was used.

COMPARISON LIQUID DEVELOPER B-3

The resin dispersion obtained in Production Example 93 of latex grains was used.

An electrophotographic light-sensitive material, ELP Master II Type (trade name, made by Fuji Photo Film Co., LOtd.) was image exposed and developed by a full-automatic processor, ELP 404V (trade name, made by Fuji Photo Film Co., LOtd.) using each of the liquid developers. The processing speed (plate making speed) was 7 plates/minute. Furthermore, the occurrence of stains of the developing apparatus by adhesion of the toner after processing 3,000 ELP Master II Type plates was checked. The blackened ratio (image area) of the duplicated image was determined using 30% original.

The results obtained are shown in Table 14 below.

TABLE 14

| Test No. | Developer | Stains of Developing Apparatus | Images of the 2,000th Plate |
|---|---|---|---|
| 1 | Developer of Invention | No stains | Clear |
| 2 | Comparison Developer A-3 | Toner residue formed markedly | Letter parts lost, solid black portion blurred, background fogged. |
| 3 | Comparison Developer B-3 | Toner residue formed slightly | Density of solid black portion of imaged portion lowered, solid black portion partially blurred |

As is clear from the above results, when each of the liquid developers was used for making printing plates under the aforesaid severe plate-making condition of very fast plate-making speed, only the liquid developer according to the present invention could provide the 3,000th plate having clear images without staining the developing apparatus.

Then, the offset printing master plate (ELP Master) prepared by processing using each of the liquid developers was used for printing in a conventional manner and the number of prints obtained before occurrences of defects of the letters on the images of the print, the lowering of the density of the solid black portions of the images, etc., was checked. The results showed that the master plate obtained using each of the liquid developer of this invention and the comparison liquid developers A-3, and B-3 provided more than 10,000 prints without accompanied by the aforesaid failure.

As described above, only the liquid developer of this invention could advantageously be used for preparing a large number of printing master plates without staining the developing apparatus.

That is, in the cases of using the comparison liquid developers A-3, and B-3, there was no problem on the number of prints, but the developing apparatus was too stained to further use subsequently.

Also, in the case of using the comparison liquid developer B-3, staining of the developing apparatus was greatly reduced as compared to the case of using the comparison liquid developer A-3, but the improvement was not satisfactory when the developing condition became severe.

That is, the known dispersion-stabilizing resin used for the comparison liquid developer B-3 has a feature that the resin is a random copolymer containing the monomer (A) (vinyl acetate in the examples) and a component having a polymerizable double bond group copolymerizing with the monomer (A), wherein the polymerizable double bond group exists in a portion near the polymer main chain, whereby the resin is considered to be inferior in the redispersibility of latex grains as compared with the dispersion-stabilizing resin of this invention.

EXAMPLE 54

A mixture of 100 g of the white resin dispersion obtained in Production Example 65 of latex grains and 1.5 g of Sumikalon Black was stirred for 4 hours at 100° C. After cooling to room temperature, the reaction mixture was passed through a 200 mesh nylon cloth to remove the remaining dye whereby a black resin dispersion having a mean grain size of 0.25 μm was obtained.

Then, a liquid developer was prepared by diluting 30 g of the aforesaid black resin dispersion, 0.05 g of zirconium naphthenate, and 20 g of a higher alcohol, FOC-1600 (trade name, made by Nissan Chemical Industries, Ltd.) with one liter of Shellsol 71.

When the liquid developer was applied to the same developing apparatus as used in Example 32, no occurrence of stains of the developing apparatus by adhesion of the toner was observed even after developing 3,000 plates.

Also, the image quality of the offset printing master plate obtained and the image quality of the 10,000th print was very clear.

EXAMPLE 55

A mixture of 100 g of the white resin dispersion obtained in Production Example 89 of latex grains and 3 g of Victoria Blue B was stirred for 6 hours at temperature of form 70° C. to 80° C. After cooling to room temperature, the reaction mixture was passed through a 200 mesh nylon cloth to remove the remaining dye, whereby a blue resin dispersion having a mean grain size of 0.25 μm was obtained.

Then, a liquid developer was prepared by diluting 32 g of the aforesaid blue resin dispersion, 0.05 g of zirconium naphthenate, and 15 g of a higher alcohol, FOC-1400 (trade name, made by Nissan Chemical Industries, Ltd.) with one liter of Isopar H.

When the liquid developer was applied to the same developing apparatus as used in Example 53, no occurrence of stains of the developing apparatus by adhesion of the toner was observed even after developing 3,000 plates. Also, the image quality of the offset printing master plate obtained was clear and the image quality of the 10,000th print was very clear.

Furthermore, when the aforesaid processing was performed after allowing to stand the liquid developer for 3 months, the results were the same as those obtained with the developer before storage.

EXAMPLE 56

In a paint shaker were placed 10 g of poly(decyl methacrylate), 30 g of Isopar H, and 8 g of Alkali Blue together with glass beads followed by dispersing to provide a fine dispersion of Alkali Blue.

Then, a liquid developer was prepared by diluting 30 g of the white resin dispersion obtained in Production Example 65 of latex grains, 4.2 g of the aforesaid Alkali Blue dispersion, 15 g of a higher alcohol, FOC-1400 (trade name, made by Nissan Chemical Industries, Ltd.), and 0.06 g of a semidocosanylamidated compound of a copolymer of diisobutylene and maleic anhydride with one liter of Isopar G.

When the liquid developer was applied to the same developing apparatus as used in Example 53, an occurrence of stains of the developing apparatus by sticking of the toner was observed even after developing 3,000 plates. Also, the image quality of the offset printing master plate and the image quality of the 10,000th print were very clear.

EXAMPLES 57 to 73

Each of liquid developers was prepared by following the same procedure as Example 56 except that 6.0 g (as a solid content) of each of the latex grains shown in Table 15 below was used in place of the white resin dispersion obtained in Production Example 65 of latex grains.

TABLE 15

| Example No. | Latex Grains | Stains of Developing Apparatus | Image of the 3,000th |
|---|---|---|---|
| 57 | D-66 | No stain | Clear |
| 58 | D-67 | No stain | Clear |
| 59 | D-68 | No stain | Clear |
| 60 | D-69 | No stain | Clear |
| 61 | D-70 | No stain | Clear |
| 62 | D-71 | No stain | Clear |
| 63 | D-72 | No stain | Clear |
| 64 | D-73 | No stain | Clear |
| 65 | D-74 | No stain | Clear |
| 66 | D-75 | No stain | Clear |
| 67 | D-76 | No stain | Clear |
| 68 | D-77 | No stain | Clear |
| 69 | D-78 | No stain | Clear |
| 70 | D-79 | No stain | Clear |
| 71 | D-80 | No stain | Clear |
| 72 | D-81 | No stain | Clear |
| 73 | D-82 | No stain | Clear |

When each of the liquid developers was applied to the same developing apparatus as that used in Example 53, no occurrence of stains of the developing apparatus by adhesion of the toner was observed. Also, the image quality of the offset printing master plate obtained and the image quality of the 10,000th print was very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising resin grains dispersed in a non-aqueous solvent having an electric resistance of at least $10^9$ Ω cm and a dielectric constant of not higher than 3.5, wherein the dispersed resin grains are copolymer resin grains obtained by polymerizing a solution containing at least one mono-functional monomer (A) which is soluble in said non-aqueous solvent, but becomes insoluble in said non-aqueous solvent by being polymerized, in the presence of a comb-like copolymer dispersion-stabilizing resin, which is soluble in said non-aqueous solvent and is composed of at least one recurring unit represented by the following formulae (Ia) and (Ib) having a weight average molecular weight of from $1\times10^3$ to $2\times10^4$;

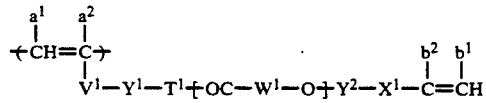

(Ia)

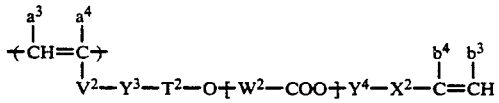

(Ib)

wherein the group in the brackets represents a recurring unit; $V^1$ represents a single bond or —COO—, —OCO—, —O—, —$CH_2)_n$COO—, —$CH_2$—OCO—, —CO—, —$SO_2$—,

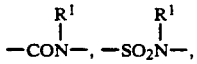

—CONHCOO, —CONHCONH—, or

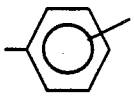

(wherein $R^1$ represents a hydrogen atom or a hydrocarbon group having from 1 to 22 carbon atoms and n represents an integer of from 1 to 3); $X^1$ has the same meaning as $V^1$; $Y^1$ represents a group linking $V^1$ to $T^1$; $Y^2$ represents a group linking $X^1$ to the recurring unit; $T^1$ represents —O— or —NH—; $W^1$ represents a divalent aliphatic organic residue or a linkage group represented by (—$Q^1$—COO—$Q^2$—) (wherein —$Q^1$— and —$Q^2$—, which may be the same or different, each represents a divalent organic residue which may be bonded via a hetero atom): $a^1$ and $a^2$, which may be the same or different, each represents a hydrogen atom, a halogen atom, a cyano group, a hydrocarbon group having from 1 to 8 carbon atoms, —COO—$R^2$, or —COO—$R^2$ bonded via a hydrocarbon group having from 1 to 8 carbon atoms (wherein $R^2$ represents a hydrogen atom or a hydrocarbon group having from 1 to 18 carbon atoms); $b^1$ and $b^2$, which may be the same or different, have the same meaning as $a^1$ and $a^2$; $V^2$ and $X^2$ have the same meaning as $V^1$ and $X^1$ in formula (Ia); $Y^3$ represents a group linking to $T^2$; $Y^4$ represents a group linking $X^2$ to the recurring unit; $W^2$ represents a divalent aliphatic organic residue or a linkage group represented by ($—Q^3—OCO—Q^4—$) (wherein $—Q^3—$ and $—Q^4—$, which may be the same or different, have the same meaning as $—Q^1—$ and $Q^2$ in formula (Ia); $T^2$ represents —CO— or a single bond; $a^3$, $a^4$, $b^3$, and $b^4$, which may be the same or different, have the same meaning as $a^1$ and $a^2$ in formula (Ia).

2. The liquid developer for electrostatic photography as in claim 1, wherein the solution containing the monofunctional monomer (A) further contains at least one kind of a monomer (B-1) represented by the following formula (II-1) which contains an aliphatic group having at least 8 carbon atoms and which is capable of forming a copolymer by copolymerization reaction with the monomer (A);

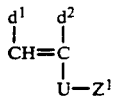

(II-1)

wherein $Z^1$ represents an aliphatic group having at least 8 carbon atoms; U represents —COO, —CONH,

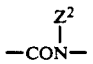

(wherein $Z^2$ represents an aliphatic group), —OCO—, $—CH_2COO—$ or —O—; and $d^1$ and $d^2$, which may be the same or different, each represents a hydrogen atom, an alkyl group, $—COOZ^3$, or $—CH_2—COOZ^3$ (wherein $Z^3$ represents an aliphatic group having from 1 to 32 carbon atoms).

3. The liquid developer for electrostatic photography as in claim 2, wherein the dispersion-stabilizing resin contains at least one kind of the recurring unit, represented by formula (III)

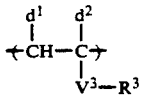

(III)

wherein $V^3$ represents —COO—, —OCO—, —O—, $—CH_2)_mCOO—$, $—CH_2)_mOCO—$, —CO—, or $—SO_2—$ (wherein m represents an integer of from 1 to 3); $R^3$ represents an alkyl or alkenyl group having at least 8 carbon atoms; and $d^1$ and $d^2$, which may be the same or different, have the same meaning as $a^1$ and $a^2$ in formula (Ia), as a copolymer component together with at least one component represented by the formulae (Ia) and (Ib).

4. The liquid developer for electrostatic photography as in claim 1, wherein the solution containing the monofunctional monomer (A) further contains at least one kind of a monomer (B-2) represented by the following formula (II-2) which has at least two polar groups and/or polar linkage groups;

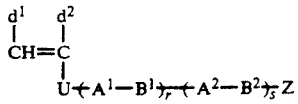

(II-2)

wherein U represents —O—, —COO—, —OCO—, $—CH_2OCO—$, $—SO_2—$, —CONH—, $—SO_2NH—$,

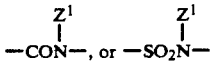

(wherein $Z^1$ represents a hydrocarbon group or the same meaning as the linkage group $—A^1)_r(A^2—B^2)_sZ$ in formula (II-2); Z represents a hydrogen atom or a hydrocarbon group having from 1 to 18 carbon atoms, which may be substituted with a halogen atom, —OH, —CN, $—NH_2$, —COOH, $—SO_3H$, or $—PO_3H_2$; $B^1$ and $B^2$, which may be the same or different, each represents —O—, —S—, —CO—, $—CO_2—$, —OCO—, $—SO_2—$,

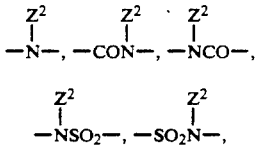

$—NHCO_2—$, or —NHCONH (wherein $Z^2$ has the same meaning as aforesaid Z); $A^1$ and $A^2$, which may be the same or different, each represents a hydrocarbon group having from 1 to 18 carbon atoms, which may be substituted or may have, in the main chain bond,

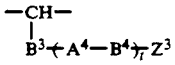

(wherein $B^3$ and $B^4$, which may be the same or different, have the same meaning as $B^1$ and $B^2$ described above; $A^4$ represents a hydrocarbon group having from 1 to 18 carbon atoms, which may be substituted; and $Z^3$ has the same meaning as $Z^1$ described above); $d^1$ and $d^2$, which may be the same or different, each represents a hydrogen atom, a hydrocarbon group, $—COO—Z^4$, or $—COO—Z^4$ bonded via a hydrocarbon (wherein $Z^4$ represents a hydrogen atom or a hydrocarbon group which may be substituted; and r, s, and t, which may be the same or different, each represents an integer of from 0 to 4, with the proviso that said r, s, and t cannot be 0 at the same time.

5. The liquid developer for electrostatic photography as in claim 4, wherein the dispersion-stabilizing resin contains at least one kind of the recurring unit, represented by formula (III)

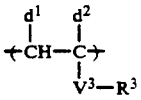

(III)

wherein $V^3$ represents —COO—, —OCO—, —O—, $—CH_2)_mCOO—$, $—CH_2)_mOCO—$, —CO—, or $—SO_2—$ (wherein m represents an integer of from 1 to 3); $R^3$ represents an alkyl or alkenyl group having at least 8 carbon atoms; and $d^1$ and $d^2$, which may be the same or different, have the same meaning as $a^1$ and $a^2$ in formula (Ia), as a copolymer component together with at least one component represented by the formulae (Ia) and (Ib).

6. The liquid developer for electrostatic photography as in claim 1, wherein the dispersion-stabilizing resin contains at least one kind of a recurring unit represented by the following formula (III) as a copolymer component together with at least one component represented by formulae (Ia) and (Ib);

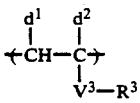

(III)

wherein $V^3$ represents —COO—, —OCO—, —O—, $—CH_2)_mCOO—$, $—CH_2)_mOCO—$, —CO—, or $—SO_2—$ (wherein m represents an integer of from 1 to 3); $R^3$ represents an alkyl or alkenyl group having at least 8 carbon atoms; and $d^1$ and $d^2$, which may be the same or different, have the same meaning as $a^1$ and $a^2$ in formula (Ia).

7. The liquid developer for electrostatic photography as in claim 1, wherein said dispersion-stabilizing resin has an average molecular weight of from $1\times10^4$ to $2\times10^4$.

8. The liquid developer for electrostatic photography as in claim 1, wherein the content of the recurring unit represented by formulae (Ia) and (Ib) in the dispersion-stabilizing resin is from 1 to 7% by weight.

9. The liquid developer for electrostatic photography as in claim 1, wherein said monomer (A) is a monomer represented by formula (V):

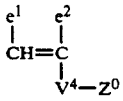

(V)

wherein $V^4$ represents —COO—, —OCO—, $—CH_2OCO—$, $—CH_2COO—$, —O—,

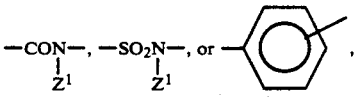

wherein $Z^1$ represents an aliphatic group having from 1 to 18 carbon atoms, which may be substituted; $Z^0$ represents a hydrogen atom or an aliphatic group having from 1 to 6 carbon atoms, which may be substituted; and $e^1$ and $e^2$, which may be the same or different, each has the same meaning as $a^1$ and $a^2$ in formula (Ia).

10. The liquid developer for electrostatic photography as in claim 1, wherein said liquid developer further comprises a coloring agent.

* * * * *